US011673241B2

(12) United States Patent
Hays et al.

(10) Patent No.: US 11,673,241 B2
(45) **Date of Patent: *Jun. 13, 2023**

(54) NOSEPIECE AND MAGAZINE FOR POWER SCREWDRIVER

(71) Applicant: BLACK & DECKER INC., New Britain, CT (US)

(72) Inventors: James Dunlap Hays, Bel Air, MD (US); John P. Zellinger, Middle River, MD (US); Rex A. Marshall, Jr., White Marsh, MD (US); Wesson Charles, Baltimore, MD (US); Joseph P. Kelleher, Parkville, MD (US); John K. Horky, Lutherville, MD (US)

(73) Assignee: BLACK & DECKER INC., New Britian, CT (US)

( * ) Notice: Subject to any disclaimer, the term of this patent is extended or adjusted under 35 U.S.C. 154(b) by 338 days.

This patent is subject to a terminal disclaimer.

(21) Appl. No.: 16/528,816

(22) Filed: Aug. 1, 2019

(65) Prior Publication Data

US 2019/0351535 A1 Nov. 21, 2019

Related U.S. Application Data

(63) Continuation of application No. 15/442,145, filed on Feb. 24, 2017, now Pat. No. 10,406,661, which is a (Continued)

(51) Int. Cl.

| | |
|---|---|
| ***B25B 21/00*** | (2006.01) |
| ***B25B 23/04*** | (2006.01) |
| ***B25B 23/00*** | (2006.01) |

(52) U.S. Cl.

CPC ..... *B25B 23/045* (2013.01); *B25B 21/00* (2013.01); *B25B 23/0064* (2013.01)

(58) Field of Classification Search

CPC .... B25B 23/045; B25B 21/00; B25B 23/0064

(Continued)

(56) References Cited

U.S. PATENT DOCUMENTS

| | | | |
|---|---|---|---|
| 1,391,601 | A | 9/1921 | Zanon |
| 1,990,991 | A | 2/1935 | Heubach |

(Continued)

FOREIGN PATENT DOCUMENTS

| | | | |
|---|---|---|---|
| CN | 201350612 | Y | 11/2009 |
| CN | 202029087 | U | 11/2011 |

(Continued)

OTHER PUBLICATIONS

Metabowerke GmbH—Machine Translation of European Patent Application No. 2489473-A2.

(Continued)

*Primary Examiner* — Robert F Long

(74) *Attorney, Agent, or Firm* — Scott B. Markow

(57) ABSTRACT

A magazine is configured to be removably coupled to a power tool housing of a power tool. The magazine has a housing configured to be rotatably attachable to the power tool housing. An advancing mechanism is received in the magazine housing, and is configured to advance a strip of collated fasteners into position to be driven by the power tool. An indexing ring has a plurality of recesses and is configured to be non-rotatably attached to the power tool housing. A detent is biased to removably engage one of the plurality of recesses, and is configured to be non-rotatably attached to the magazine housing. The detent removably engages the recesses to allow for indexed tool-free rotation of the magazine housing relative to the power tool housing.

19 Claims, 39 Drawing Sheets

Related U.S. Application Data continuation of application No. 14/186,088, filed on Feb. 21, 2014, now Pat. No. 9,616,557.

(60) Provisional application No. 61/909,493, filed on Nov. 27, 2013, provisional application No. 61/783,256, filed on Mar. 13, 2013.

(58) Field of Classification Search
USPC ..... 227/119–139, 8, 156; 173/118–120, 213
See application file for complete search history.

(56) References Cited

U.S. PATENT DOCUMENTS 2,153,430 A 4/1939 Newman
2,204,178 A 6/1940 Gartner
2,342,539 A 2/1944 Gorton
2,501,648 A 3/1950 Ogden
2,511,505 A 6/1950 Hemmerling
2,600,652 A 6/1952 Huck
2,768,547 A 10/1956 Noell
2,900,858 A 8/1959 Gauthier et al.
2,943,652 A 7/1960 Chilton
3,196,237 A 7/1965 Westgate, Jr.
3,198,893 A 8/1965 Mapelsden
3,554,246 A 1/1971 Halstead
3,605,210 A 9/1971 Lohr
3,620,105 A * 11/1971 Batten ..... B25B 21/002 81/57.14
3,712,352 A 1/1973 Lafferty, Sr.
3,915,242 A 10/1975 Bell
3,920,169 A 11/1975 DeCaro
3,930,297 A * 1/1976 Potucek ..... B25B 23/045 29/431
4,014,488 A * 3/1977 Potucek ..... B25B 23/045 226/6
4,022,287 A * 5/1977 Lundstrom ..... E21B 17/0426 285/332
4,034,178 A 7/1977 Koppenheffer et al.
4,038,508 A 7/1977 Mapelsden
4,051,880 A 10/1977 Hestily
4,063,443 A 12/1977 Yarbrough
4,182,939 A 1/1980 Feaster
4,217,681 A 8/1980 Grohoski et al.
4,282,415 A 8/1981 Schimizu et al.
4,414,743 A 11/1983 Pioch et al.
4,428,261 A * 1/1984 Takatsu ..... B25B 23/045 227/120
4,436,125 A 3/1984 Blenkush
4,442,738 A * 4/1984 Spencer ..... B25B 23/145 81/474
4,458,957 A 7/1984 Greener
4,495,387 A 1/1985 Thrush
4,517,863 A 5/1985 Ishikawa
4,754,104 A 6/1988 Maltais et al.
4,774,863 A * 10/1988 Geist ..... B25B 23/045 81/433
4,815,647 A 3/1989 Chou
4,858,811 A * 8/1989 Brosius ..... B25C 1/143 227/10
4,905,938 A 3/1990 Braccio et al.
4,921,375 A 5/1990 Famulari
4,998,981 A * 3/1991 Miyanaga ..... B23B 51/0045 175/286
5,090,747 A 2/1992 Kotake
5,101,697 A 4/1992 Fishback
5,170,545 A 12/1992 Hubscher
5,211,693 A 5/1993 Pacher
5,224,230 A 7/1993 Vanicsek et al.
5,228,244 A 7/1993 Chu
5,231,900 A * 8/1993 Deri ..... B25B 23/045 81/434
5,281,056 A 1/1994 Lawson et al.
5,303,620 A * 4/1994 Payne ..... B25B 23/045 206/345
5,339,713 A 8/1994 Hou
5,341,704 A 8/1994 Klemm
5,374,073 A 12/1994 Hung-Hsin
5,402,695 A 4/1995 Hornung
5,414,895 A 5/1995 Kazmark, Jr.
5,447,343 A 9/1995 Gajewski et al.
5,482,413 A 1/1996 Argaud
5,487,316 A 1/1996 Hornung et al.
5,511,715 A * 4/1996 Crutcher ..... B25C 1/06 227/8
5,515,576 A 5/1996 Tsai
5,522,615 A 6/1996 Kazmark, Jr. et al.
5,524,512 A 6/1996 Wolfe
5,526,908 A 6/1996 Wang
5,531,142 A 7/1996 Adamo
5,564,717 A 10/1996 Alberts
5,589,671 A 12/1996 Hackbarth et al.
5,601,387 A 2/1997 Sanford et al.
5,662,011 A 9/1997 Habermehl
5,671,645 A * 9/1997 Murayama ..... B25B 23/045 81/434
5,687,624 A 11/1997 Tsuge et al.
5,713,440 A 2/1998 Chen
5,716,730 A 2/1998 Deguchi
5,732,443 A 3/1998 Kazmark, Jr. et al.
5,810,132 A 9/1998 Chang
5,826,468 A 10/1998 Daubinger et al.
5,855,151 A 1/1999 Habermehl
5,890,405 A * 4/1999 Becker ..... B25B 23/14 81/434
5,899,126 A 5/1999 Fujiyama et al.
5,904,079 A 5/1999 Tsuge et al.
5,906,407 A 5/1999 Schmiechel
5,941,441 A * 8/1999 Ilagan ..... B25C 1/06 227/131
5,941,543 A 8/1999 Kazmark, Jr.
5,951,026 A 9/1999 Harman, Jr. et al.
5,974,918 A 11/1999 Nakagawa et al.
5,988,025 A 11/1999 Sasaki et al.
5,988,026 A 11/1999 Reckelhoff et al.
6,014,793 A 1/2000 Howald
6,047,971 A 4/2000 Harman, Jr. et al.
6,058,815 A 5/2000 Habermehl
6,065,576 A 5/2000 Shaw et al.
6,079,716 A 6/2000 Harman, Jr. et al.
6,095,303 A 8/2000 Gutmann et al.
6,102,134 A 8/2000 Alsruhe
6,109,144 A 8/2000 Muro
6,109,145 A 8/2000 Habermehl
6,129,190 A 10/2000 Reed et al.
6,138,535 A * 10/2000 Jalbert ..... B25B 23/0035 81/57.37
6,138,536 A * 10/2000 Chen ..... B25B 23/10 81/57.37
6,142,537 A 11/2000 Shimada et al.
6,148,646 A 11/2000 Koshiga et al.
6,170,366 B1 1/2001 Jalbert et al.
6,186,035 B1 2/2001 Jalbert et al.
6,230,594 B1 5/2001 Jalbert et al.
6,247,867 B1 6/2001 Speer
6,254,321 B1 7/2001 Lind
6,263,945 B1 7/2001 Nien
6,293,559 B1 9/2001 Harman, Jr. et al.
6,296,166 B1 10/2001 Huang
6,318,135 B1 11/2001 Koshiga et al.
6,318,937 B1 11/2001 Lind
6,321,856 B1 11/2001 Alsruhe
6,328,509 B1 11/2001 Lind
6,354,635 B1 3/2002 Dyson et al.
6,374,696 B1 4/2002 Blake, III et al.
6,431,036 B1 * 8/2002 Obermeier ..... B25B 23/06 81/57.37
6,467,556 B2 10/2002 Alsruhe
6,499,381 B2 12/2002 Ladish et al.
6,546,762 B2 4/2003 Koshiga et al.
6,551,037 B2 4/2003 Gifford et al.
6,571,926 B2 6/2003 Pawley
6,615,895 B2 9/2003 Marocco
6,647,836 B1 11/2003 Habermehl

(56) References Cited

U.S. PATENT DOCUMENTS 6,688,611 B2 2/2004 Gifford et al.
6,701,811 B1 3/2004 Chang et al.
6,758,116 B2 7/2004 Kriaski et al.
6,790,144 B2 9/2004 Talesky
6,802,410 B2 10/2004 Dyson et al.
6,814,213 B2 11/2004 Dyson et al.
6,821,048 B2 11/2004 Talesky
6,845,693 B1 * 1/2005 Babij, Jr. ..... B25B 23/04 81/57.37
6,880,607 B2 4/2005 Marocco
6,904,834 B2 6/2005 Lin
6,907,971 B2 6/2005 Demir et al.
6,912,932 B2 7/2005 Kriaski et al.
6,915,724 B2 7/2005 Kigel et al.
6,974,064 B1 * 12/2005 Chou ..... B25C 1/186 227/10
6,990,731 B2 1/2006 Haytayan
7,066,678 B2 6/2006 Huang
7,073,699 B2 7/2006 Seidler
7,121,174 B2 10/2006 Lai et al.
7,121,362 B2 10/2006 Hsu et al.
7,134,367 B2 11/2006 Gehring et al.
7,137,457 B2 11/2006 Fauhammer et al.
7,165,481 B2 1/2007 Kikuchi
7,165,920 B2 1/2007 Baber
7,168,897 B2 1/2007 Baber
7,231,854 B2 6/2007 Kikuchi
7,237,457 B2 7/2007 Hsu
7,274,554 B2 9/2007 Kang et al.
7,276,824 B2 10/2007 Statnikov et al.
7,293,486 B2 11/2007 Chang
7,331,738 B2 2/2008 Hofbrucker et al.
7,344,058 B2 3/2008 Bruins et al.
7,374,377 B2 5/2008 Bauman
7,401,659 B2 7/2008 Hsu
7,424,840 B1 9/2008 Huang
7,451,791 B2 11/2008 Cooper et al.
7,454,996 B2 11/2008 Hsu
7,455,205 B2 11/2008 Palley et al.
7,487,699 B2 2/2009 Xu
7,493,839 B2 2/2009 Massari, Jr. et al.
7,510,356 B2 3/2009 Colon
7,633,246 B2 12/2009 Bernier et al.
RE41,078 E 1/2010 Schmeichel
7,654,294 B2 2/2010 Cooper et al.
7,661,340 B2 2/2010 Xu
7,757,704 B2 7/2010 Lien
7,758,274 B2 7/2010 Paul
7,793,572 B2 9/2010 Hirt et al.
7,810,414 B2 10/2010 Hsu
7,823,483 B2 11/2010 Yamada
7,841,218 B2 11/2010 Dominguez et al.
7,874,232 B2 1/2011 Gauthreaux et al.
7,950,312 B2 5/2011 Matthiesen et al.
7,992,469 B2 8/2011 Chang et al.
7,997,171 B2 8/2011 Massari, Jr. et al.
8,047,100 B2 11/2011 King
D654,147 S 2/2012 Bell et al.
8,172,235 B2 5/2012 Furusawa et al.
8,220,367 B2 7/2012 Hsu
8,240,011 B2 8/2012 Chevrolet
8,240,055 B2 8/2012 Gooding
8,240,232 B2 8/2012 Hale
8,261,642 B2 9/2012 Braendstroem et al.
8,302,282 B2 11/2012 Wille
8,328,475 B2 12/2012 Naughton et al.
8,337,124 B2 12/2012 Nguyen
8,348,116 B2 1/2013 Xu
8,360,439 B2 1/2013 Hirt et al.
8,369,746 B2 2/2013 Tamura
8,413,740 B2 4/2013 Rodenhouse
8,434,187 B2 5/2013 Weinberger et al.
8,500,173 B2 8/2013 Zahler et al.
8,627,749 B2 1/2014 Desmond et al.
8,677,868 B2 3/2014 Hoffman et al.
8,726,765 B2 5/2014 Hoffman
9,616,557 B2 * 4/2017 Hays ..... B25B 23/0064
2002/0100347 A1 * 8/2002 Daubinger ..... B25B 23/045 81/469
2004/0006860 A1 1/2004 Haytayan
2004/0084499 A1 5/2004 Tsai
2004/0089118 A1 * 5/2004 Habermehl ..... B25B 23/045 81/434
2004/0112183 A1 6/2004 Huang et al.
2004/0123704 A1 * 7/2004 Kigel ..... B25B 23/0064 81/434
2005/0057042 A1 3/2005 Wicks
2005/0135890 A1 * 6/2005 Bauman ..... B23B 45/003 408/239 R
2005/0166390 A1 8/2005 Gooding et al.
2005/0279517 A1 12/2005 Hoffman et al.
2006/0033002 A1 * 2/2006 Hsu ..... B25B 23/045 248/694
2006/0088393 A1 4/2006 Cooper
2006/0191385 A1 8/2006 Massari, Jr. et al.
2008/0202294 A1 * 8/2008 Huang ..... B25B 23/045 81/435
2008/0223185 A1 9/2008 Massari et al.
2008/0289839 A1 11/2008 Hricko et al.
2009/0020303 A1 1/2009 Gooding
2009/0314143 A1 * 12/2009 Chen ..... B25B 23/045 81/433
2010/0102514 A1 4/2010 Lipot
2011/0204621 A1 8/2011 Whitaker et al.
2011/0207340 A1 8/2011 Cairns
2012/0074658 A1 * 3/2012 Puzio ..... B25B 23/0035 279/134
2012/0090863 A1 4/2012 Puzio et al.
2012/0210831 A1 8/2012 Liang
2013/0036876 A1 2/2013 Hale
2013/0093142 A1 4/2013 Saur et al.
2013/0093149 A1 4/2013 Saur et al.
2013/0112046 A1 5/2013 Desmond et al.
2013/0112050 A1 5/2013 Desmond et al.
2013/0112051 A1 5/2013 Desmond et al.
2013/0152744 A1 6/2013 Liu
2013/0167691 A1 7/2013 Ulllrich et al.
2014/0305068 A1 * 10/2014 Svanberg ..... B25B 31/00 52/711
2015/0343583 A1 * 12/2015 McRoberts ..... B25F 5/02 173/213
2017/0028537 A1 * 2/2017 McClung ..... B25B 13/06
2017/0028543 A1 * 2/2017 Chen ..... B23B 45/003

FOREIGN PATENT DOCUMENTS

CN 202238509 U 5/2012
DE 1923712 A1 11/1970
DE DD-210641 A1 6/1984
DE 3330962 A1 3/1985
DE 9209251 U1 9/1992
DE 29800189 U1 3/1998
DE 20309492 U1 10/2003
DE 102006018976 B3 11/2007
DE 10109956 B4 4/2009
DE 202011002771 U1 4/2011
DE 102012200399 A1 5/2012
EP 0626239 A1 11/1994
EP 0749807 A1 12/1996
EP 1864758 B1 7/2010
EP 2258518 A2 12/2010
EP 2363246 A2 9/2011
EP 2444202 A2 4/2012
EP 2489473 A2 * 8/2012 ..... B25B 21/02
EP 2349648 B1 6/2013
EP 2610032 A1 7/2013
GB 2414211 B 4/2006
GB 2429671 B 10/2007
GB 2435002 B 5/2008
JP 4434069 B2 * 3/2010 ..... B25B 23/045

(56) References Cited

FOREIGN PATENT DOCUMENTS

| | | | |
|---|---|---|---|
| TW | 200950936 | A | 12/2009 |
| TW | 201300204 | A | 1/2013 |

OTHER PUBLICATIONS

Dewaele, Karl—Office Action re Related European Patent Application No. 14158872.3—Feb. 23, 2016—6 pages—The Hague.
Dewaele, Karl—Office Action re Related European Patent Application No. 14158872.3—Sep. 9, 2014—9 pages—The Hague.
English Translation of EP2489473A2, published Aug. 22, 2012.

* cited by examiner

NOSEPIECE AND MAGAZINE FOR POWER SCREWDRIVER

CROSS REFERENCE TO RELATED APPLICATIONS

This application claims priority, under 35 U.S.C. § 120, as a continuation of U.S. patent application Ser. No. 15/442,145, filed Feb. 24, 2017, titled "Nosepiece and Magazine for Power Screwdriver," which claims priority, under 35 U.S.C. § 120, as a continuation of U.S. patent application Ser. No. 14/186,088, filed Feb. 21, 2014, titled "Nosepiece And Magazine For Power Screwdriver," which claims priority, under 35 U.S.C. § 119(e), to U.S. Provisional Patent Application Nos. 61/783,256, filed Mar. 13, 2013, titled "Nosepiece And Magazine For Power Screwdriver," and 61/909,493, filed Nov. 27, 2013, titled "Nosepiece And Magazine For Power Screwdriver." Each of the aforementioned applications is incorporated by reference in its entirety.

FIELD

The present disclosure relates to a screw driving tool having a removable depth adjusting nosecone assembly and magazine for feeding collated screws.

BACKGROUND

A power screwdriver, such as screw gun, generally has a housing, a motor, and an output bit holder driven by the motor via a transmission. The screwdriver may include a removable nosepiece configured to adjust the depth to which a screw can be driven by the screwdriver. The screwdriver may also include a removable magazine configured to feed a collated strip of screws into the magazine for driving by the screwdriver.

SUMMARY

In an aspect, a magazine is configured to be removably coupled to a power tool housing of a power tool. The magazine has housing configured to be rotatably attachable to the power tool housing. An advancing mechanism is received in the magazine housing, and is configured to advance a strip of collated fasteners into position to be driven by the power tool. An indexing ring has a plurality of recesses and is configured to be non-rotatably attached to the power tool housing. A detent is biased to removably engage one of the plurality of recesses, and is configured to be non-rotatably attached to the magazine housing. The detent removably engages the recesses to allow for indexed tool-free rotation of the magazine housing relative to the power tool housing.

Implementations of this aspect may include one or more of the following features. The indexing ring may include a central opening having at least one flat wall that engages a corresponding flat on the power tool housing to prevent rotation of the indexing ring relative to the housing. The recesses may be disposed on a peripheral edge of the indexing ring. The detent may include a leaf spring and a protrusion on the leaf spring, where the leaf spring biases the protrusion with respect to the recesses. The detent may include a lock bolt or lock pin, and spring that biases the lock bolt or lock pin with respect to the recesses. The indexing ring may include a peripheral edge with the recesses and a central opening with at least one flat wall that engages a corresponding flat on the power tool housing to prevent rotation of the indexing ring relative to the power tool housing. The detent may be non-rotatably coupled to the magazine housing and may include a leaf spring and a protrusion on the leaf spring, the leaf spring biasing the protrusion into engagement with one of the recesses.

The magazine may further include a tool-free attachment mechanism configured to removably attach the magazine housing to the power tool housing in an axially fixed manner. The attachment mechanism may include a ring-like structure with a button portion disposed proximal a first side of the magazine housing and an ear disposed proximal a second side of the magazine housing, the ear being movable by actuation of the button in a radial direction between a locked position where the ear engages a groove on the power tool housing and an unlocked position where the ear is disengaged from the groove. A spring may bias the ear toward the locked position. The attachment mechanism may include a bayonet connection including a lock disc that rotates with a lock collar to engage a groove in the power tool housing.

The magazine may further include a bit guide that includes an annular flange portion coupled to the indexing ring and a hollow conical portion extending from the annular flange portion and tapering inward toward the advancing mechanism. The bit guide may be configured to receive a screwdriving bit received in a tool holder of the power tool for proper alignment of the screwdriving bit relative to the collated fasteners.

In another aspect, a magazine is configured to be coupled to a power tool housing having a tool holder for holding a screwdriving bit. The magazine includes a magazine housing having a rear end portion with an attachment mechanism configured to removably attach the magazine housing to the power tool housing, and a front end portion that receives an advancing mechanism configured to advance a strip of collated fasteners into position to be driven by the screwdriving bit. A bit guide is coupled to the rear end portion of the magazine housing. The bit guide includes a rear annular flange portion and a front hollow conical portion extending forward from the annular flange portion and tapering inward toward the front end portion of the magazine housing. The bit guide is configured to receive the screwdriving bit for proper alignment of the screwdriving bit relative to the collated fasteners.

Implementations of this aspect may include one or more of the following features. An indexing disc may be fixed to the annular flange portion of the bit guide. The indexing disc may have a plurality of recesses and may be non-rotatably attachable to the power tool housing. A detent may be non-rotatably attached to the magazine housing and biased to removably engage one of the plurality of recesses to allow for indexed tool-free rotation of the magazine housing relative to the power tool housing.

In another aspect, a power tool has a power tool housing that contains a motor and a transmission, a handle extending from the power tool housing, and a tool holder for holding a screwdriving bit. The tool holder is driven in rotation relative to the power tool housing by the motor and the transmission. A magazine includes a magazine housing configured to be removably and rotatably attachable to the power tool housing. An advancing mechanism is received in the magazine and configured to advance a strip of collated fasteners into position to be driven by the screwdriving bit. An indexing ring has a plurality of recesses and is non-rotatably attachable to one of the magazine housing and the power tool housing. A detent is biased to removably engage one of the plurality of recesses, and is non-rotatably attachable to the other the magazine housing and the power tool housing to allow for indexed tool-free rotation of the magazine housing relative to the power tool housing.

Implementations of this aspect may include one or more of the following features. The indexing ring may include a peripheral edge that includes the recesses and a central opening with at least one flat wall that engages a corresponding flat on the power tool housing to prevent rotation of the indexing ring relative to the power tool housing. The magazine housing may include a tool-free attachment mechanism configured to removably attach the magazine housing to the power tool housing in an axially fixed manner. The attachment mechanism may include a ring-like structure with a button portion disposed proximal a first side of the magazine housing and an ear disposed proximal a second side of the magazine housing, the ear being movable by actuation of the button in a radial direction between a locked position where the ear engages a groove on the power tool housing and an unlocked position where the ear is disengaged from the groove. A spring may bias the ear toward the locked position.

The magazine housing may include a bit guide that includes an annular flange portion coupled to the indexing ring and a hollow conical portion extending from the annular flange portion and tapering inward toward the advancing mechanism. The bit guide may be configured to receive the screwdriving bit for proper alignment of the screwdriving bit relative to the collated fasteners The magazine and power tool may be provided with a depth adjusting nose cone assembly with a depth adjustment collar screw threaded to a depth adjuster and a lock collar for removably attaching the nose cone assembly to the power tool housing. The nose cone assembly and the magazine may be interchangeably attachable to the magazine housing.

These and other implantations are within the scope of the drawings, the following description, and the claims.

BRIEF DESCRIPTION OF THE DRAWINGS

Example embodiments will now be described more fully with reference to the accompanying drawings.

DETAILED DESCRIPTION

Figure 1:
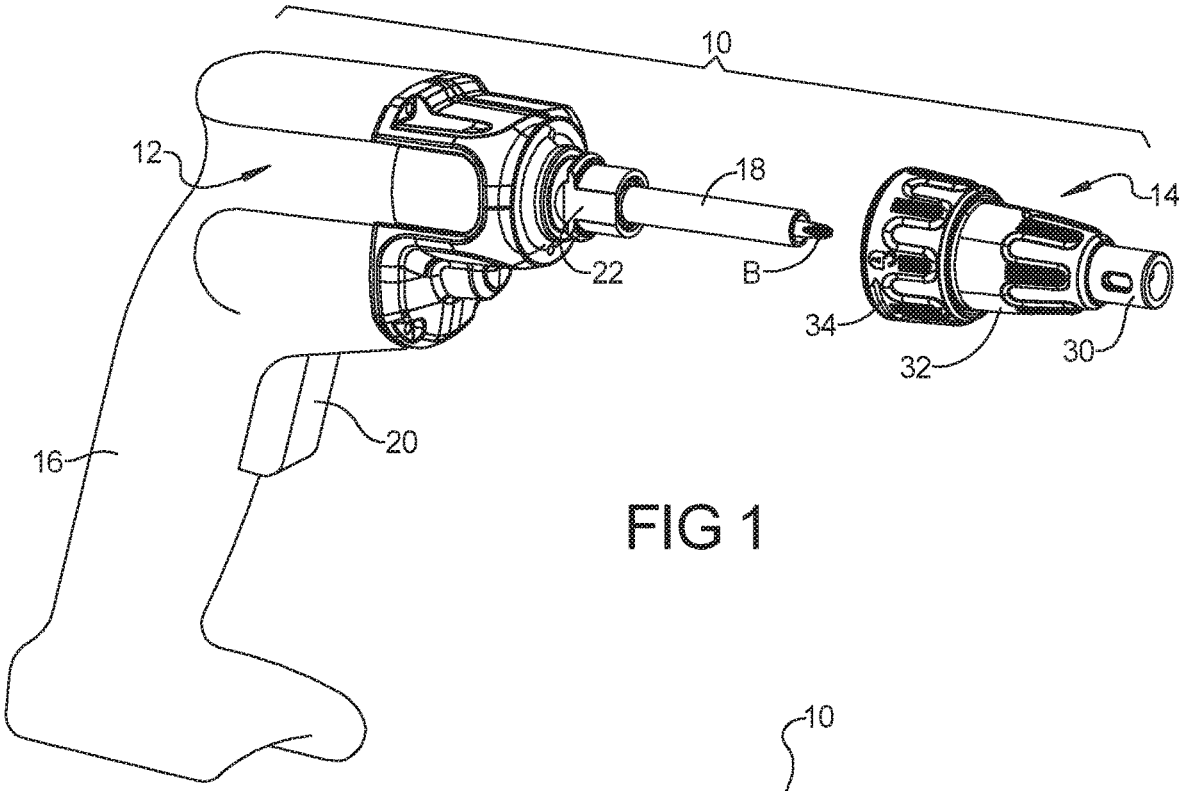
FIGS. 1 and 2 are perspective views of a power screwdriver with a removable nosepiece.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
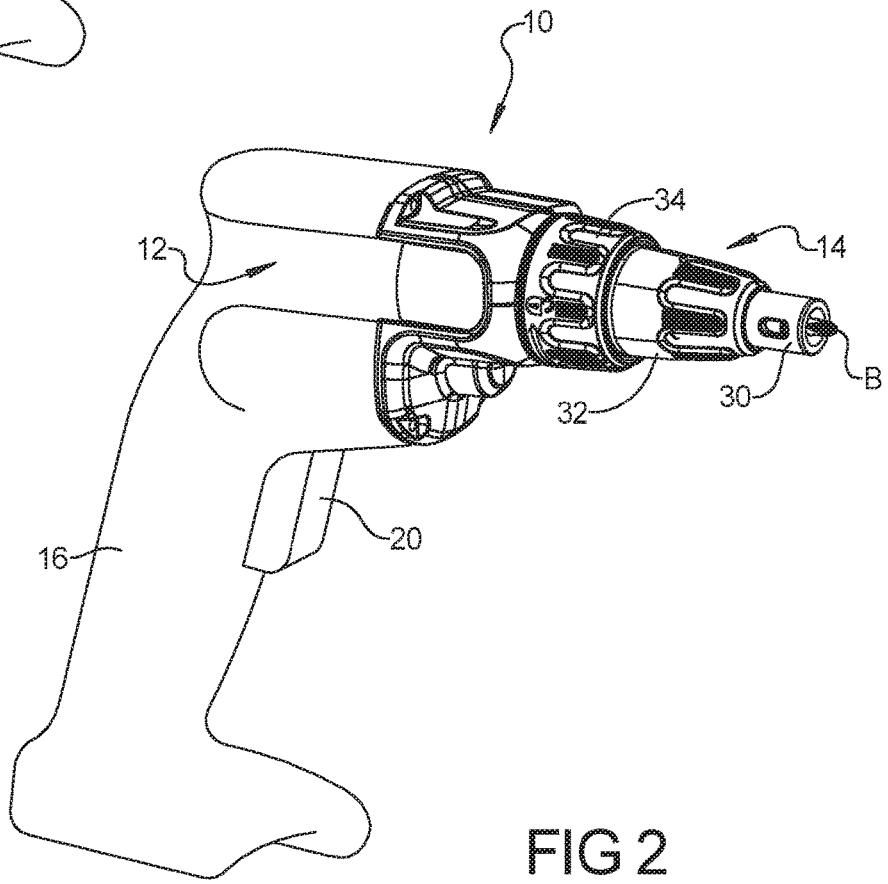

With reference to FIGS. 1 and 2 of the drawings, an exemplary screwdriving tool constructed in accordance with the teachings of the present disclosure is generally indicated by reference numeral 10. The screwdriving tool 10 can comprise a driving tool 12 and a depth adjusting nose cone assembly 14 that can be removably coupled to the driving tool 12.

The driving tool 12 can be any type of power tool that is configured to provide a rotary output for driving a threaded fastener, such as a screwgun, a drill/driver, a hammer-drill/driver, an impact driver or a hybrid impact driver. Exemplary driving tools are disclosed in commonly assigned U.S. patent application Ser. No. 12/982,711 and commonly assigned U.S. Pat. No. 5,601,387, which are herein incorporated by reference in their entirety.

The driving tool 12 can include a clamshell housing 16 enclosing a motor assembly, and a transmission disposed within a gear case 22. A bit holder 18 is drivingly attached to a drive spindle of the transmission. An output can be driven by the transmission and can include a chuck. The motor assembly can include any type of motor, such as an AC motor, a DC motor, a brushless motor, a universal motor, or a pneumatic motor. In the particular example provided, the motor assembly can be a brushless DC electric motor that is selectively coupled to a battery pack via a trigger assembly 20. For a more detailed description of a drive arrangement suitable for use with the depth adjusting system of the present invention, reference may be had to U.S. Pat. No. 4,647,260, which is incorporated by reference in its entirety. However, the power tool of the present disclosure is operable with any drive arrangement in which driving power transferred to a screwdriver bit B.

Figure 3:
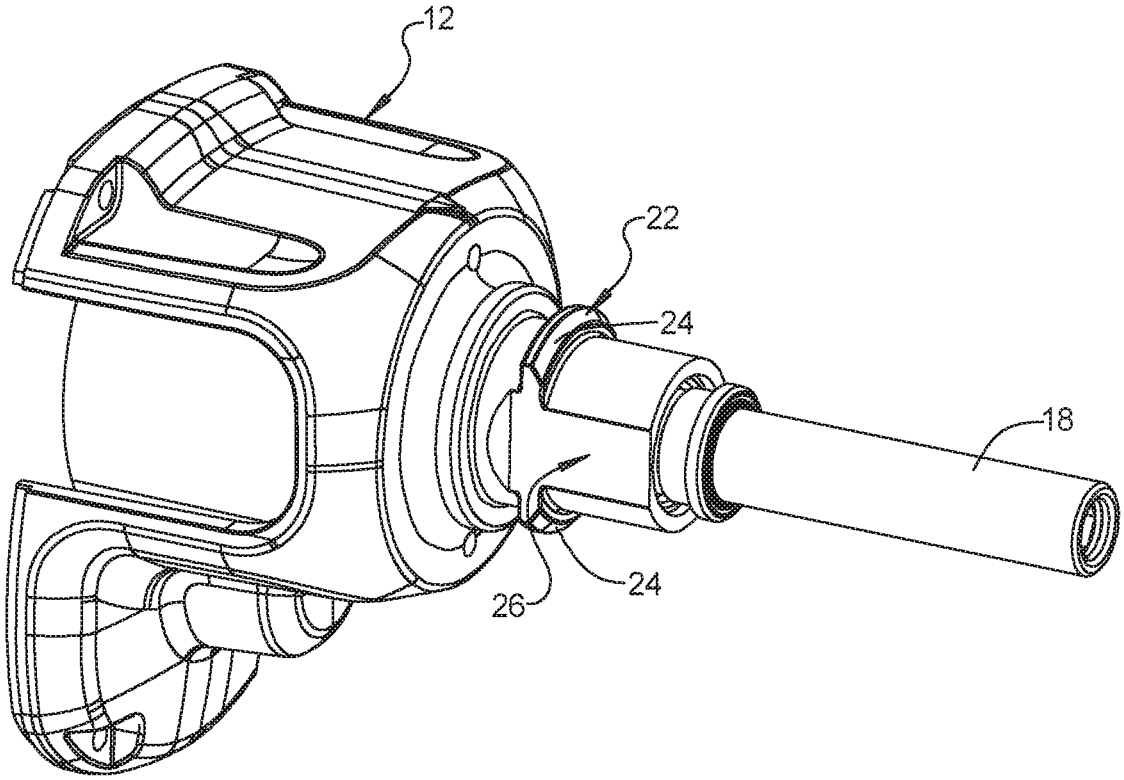
FIG. 3 is a perspective view of a power screwdriver with the nosepiece removed.

With additional reference to FIG. 3, the gear case 22 can provide a bayonet-type nose cone attachment wherein the gear case 22 has radially extending flanges 24 disposed on opposite sides of a pair of flats 26. The gear case 22 receives the depth adjusting nose cone assembly 14 as shown in FIG. 2.

Figure 4:
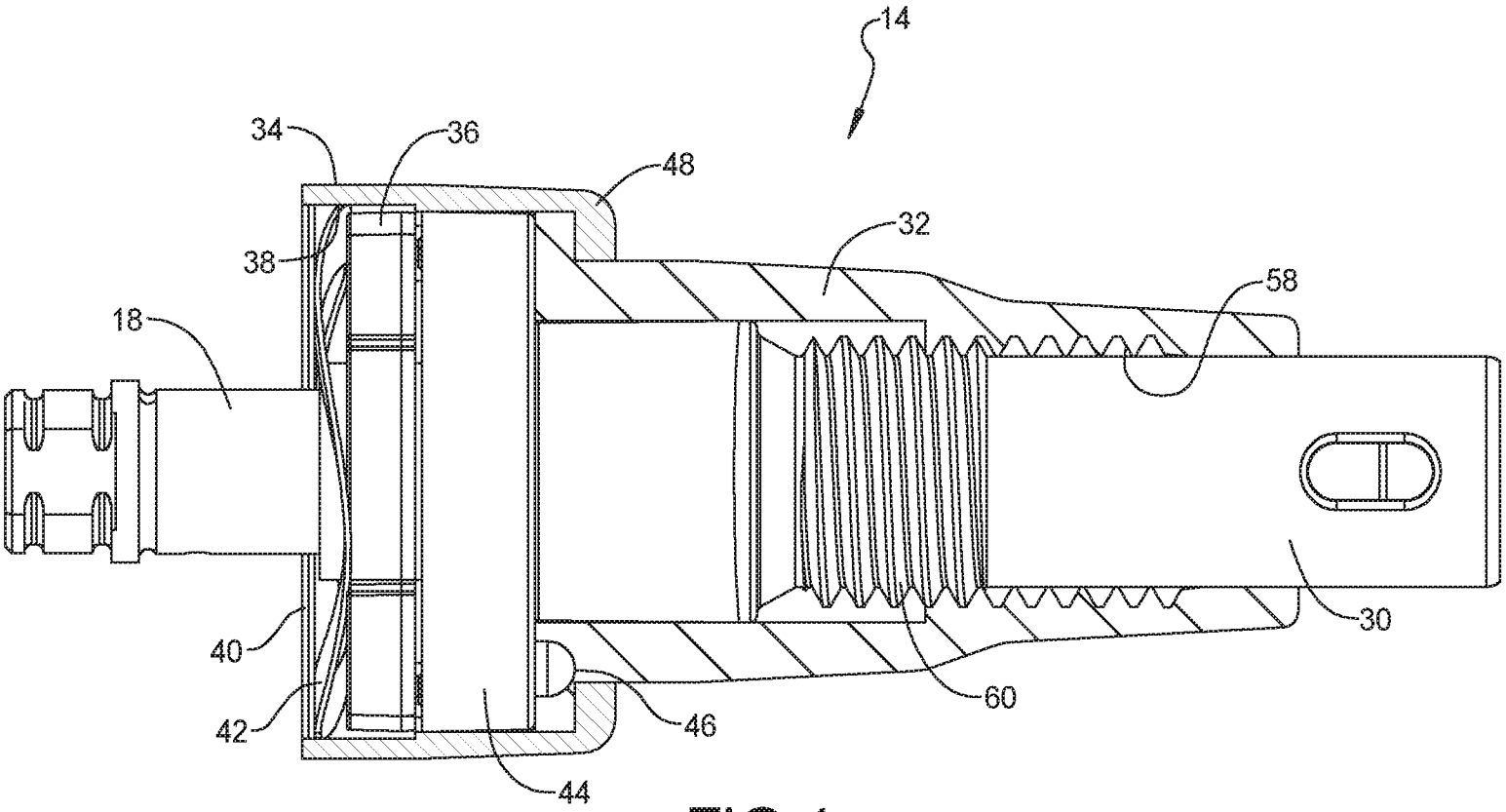
FIGS. 4 and 5 are cross-sectional views of a nosepiece for a power screwdriver.
Figure 5:
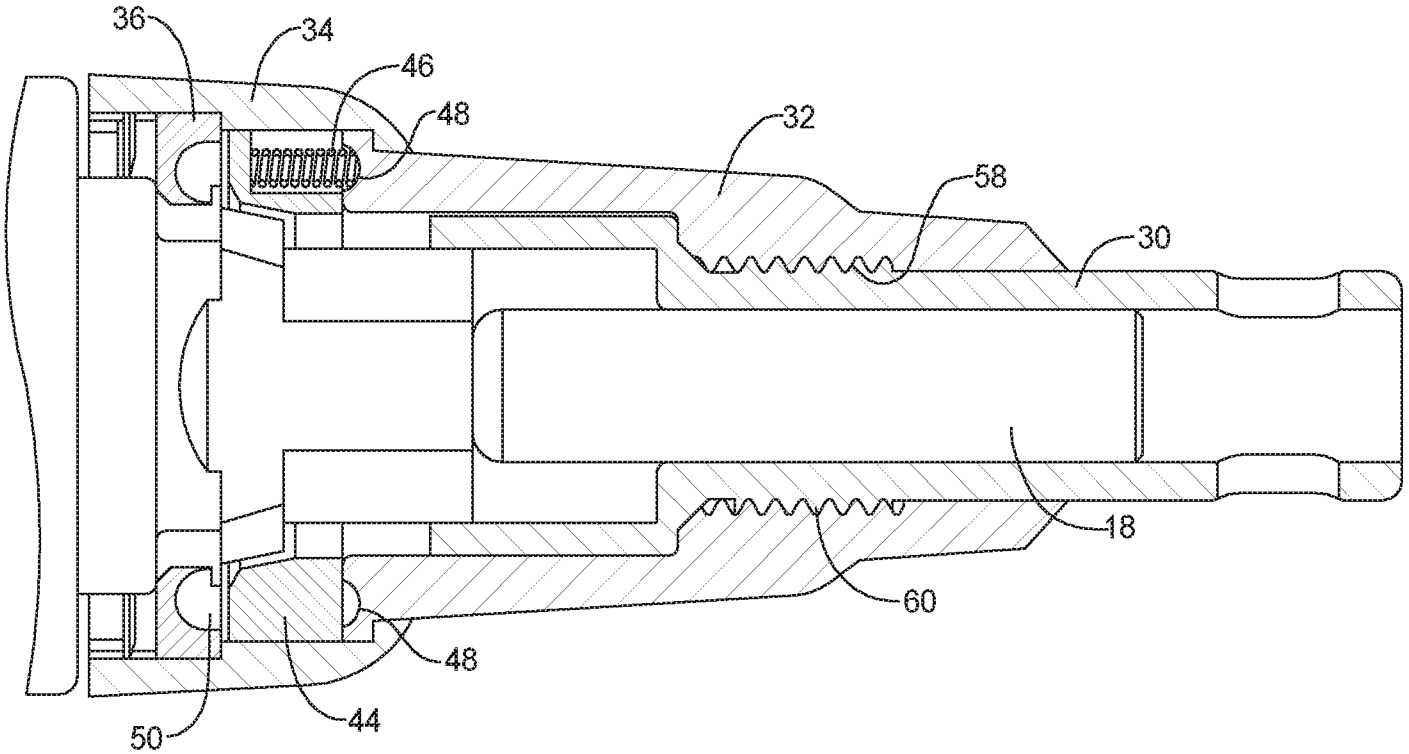
Figure 5A:
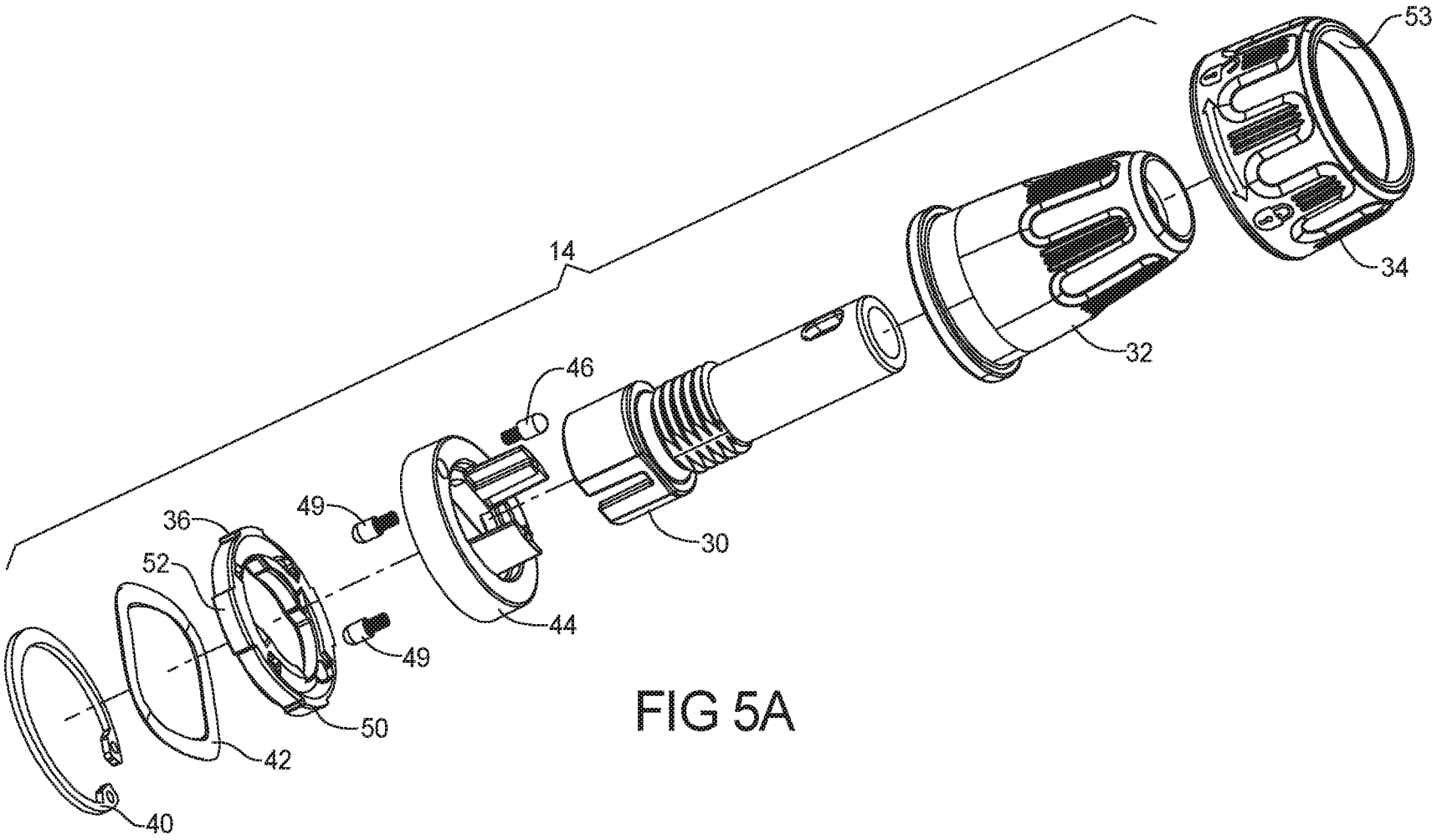
FIG. 5A is an exploded view of the nosepiece of FIGS. 4 and 5.

With reference to FIGS. 4, 5, and 5*a*, the depth adjusting nose cone assembly 14 includes a depth adjuster 30 and an adjustment collar 32 that are secured to the gear case 22 by a lock collar 34 and lock plate 36. The lock collar 34 includes an interior groove 38 that receives a retaining clip 40 for retaining a wave spring 42 against a rearward surface of the lock plate 36. A spring holder assembly 44 is disposed between the lock plate 36 and a rear end of the adjustment collar 32. The spring holder 44 supports a spring-loaded indexing bolt 46 in engagement with one of several semi-spherical recesses 48 provided in the rear face of the adjustment collar 32. The spring holder 44 also includes rearwardly facing spring loaded indexing bolts 49 that engage quarter turn indexing grooves 50 provided on a forward face of the lock plate 36. The wave spring 42 biases the lock plate 36 in a forward direction to hold the nose cone assembly 14 in place. The spring holder assembly 44 keeps tension on the lock plate 36 so that the lock plate cannot rotate out of position.

Figure 6:
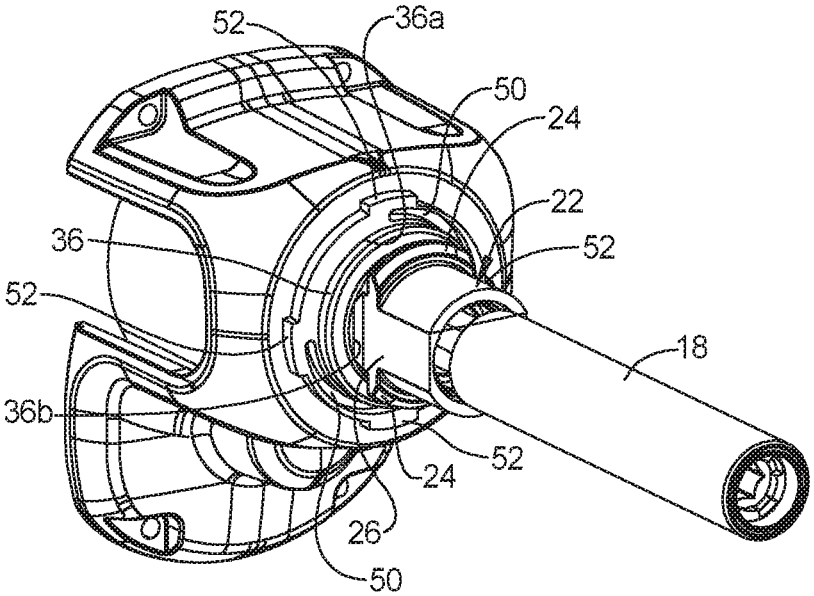
FIGS. 6 and 7 are perspective views of an attachment mechanism for a nosepiece and power screwdriver.
Figure 7:
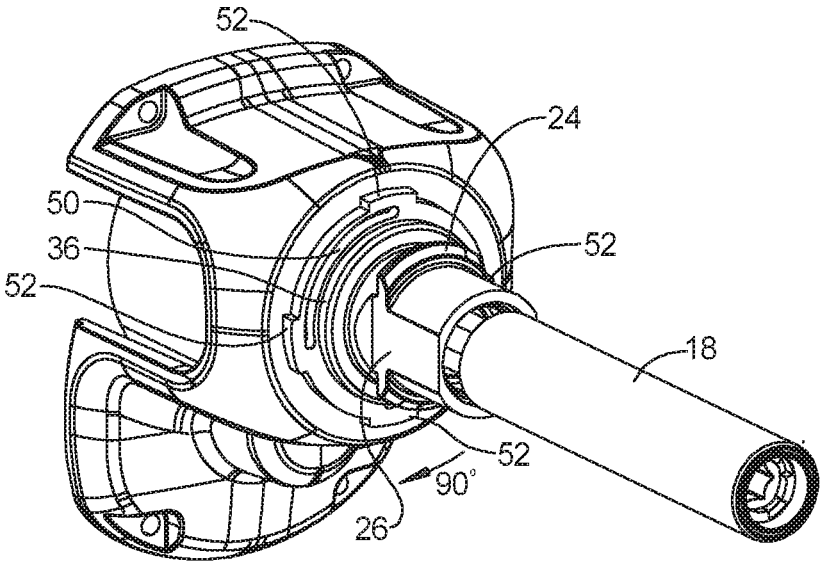

With reference to FIGS. 6 and 7, the bayonet-type engagement between the lock plate 36 and gear case 22 will now be described. The lock plate 36 includes a central aperture therethrough that has a pair of cylindrical inner walls 36*a* disposed between a pair of flat parallel walls 36*b*. As illustrated in FIG. 6, the lock plate 36 is slid over the gear case 22 so that the flat walls 36*b* align with the flats 26 provided on the gear case 22. The lock plate 36 can then be rotated 90° as illustrated in FIG. 7 to a locked engaged position where the flat walls 36*b* engage behind the flanges 24. The lock plate 36 can include a ramp surface that when rotated causes the lock plate 36 to compress the wave spring 42. This pulls the lock collar 34 rearward against the rear flange of the adjustment collar 32 to hold the adjustment collar 32 tight to the tool. It is noted that the lock plate 36 is engaged with the gear case 22 as part of the nose cone subassembly 14, although FIGS. 6 and 7 show this engagement with the remaining components of the nose cone assembly 14 removed for illustrative purposes. The lock plate 36 has radially outwardly extending protrusions 52 which non-rotatably engage or key with corresponding recesses 53 provided on an interior surface of the lock collar 34. Accordingly, when the depth adjusting nose cone assembly 14 is inserted over top of the gear case 22 and the lock collar 34 is rotated, the lock plate 36 is lockingly engaged behind the flange portions 24 of the gear case 22. The spring 42 applies an axial force against the lock plate 36 and spring holder 44 that tend to cause the indexing bolts 46 to be seated tightly within the spherical recesses 48 to hold the adjustment collar 32 in a fixed position.

The adjustment collar 32 includes internal threads 58 that engage external threads 60 on the depth adjuster 30. The adjustment collar 32 can be rotated against the resistance of the indexing bolts 46 to cause the axial position of the depth adjuster 30 to be adjusted axially in or out relative to the adjustment collar 32. Therefore, the position of the depth adjuster 30 can be positioned as desired relative to the driver bit B received in the bit holder 18.

The depth adjusting nosecone assembly 14 can be removed by rotating the locked collar 34 by approximately 90° in the opposite direction so that the flat sidewalls 36*b* of the lock plate 36 align with the flats 26 on the gear case 22 so that the depth adjusting nose cone assembly 14 can be axially removed.

Figure 8:
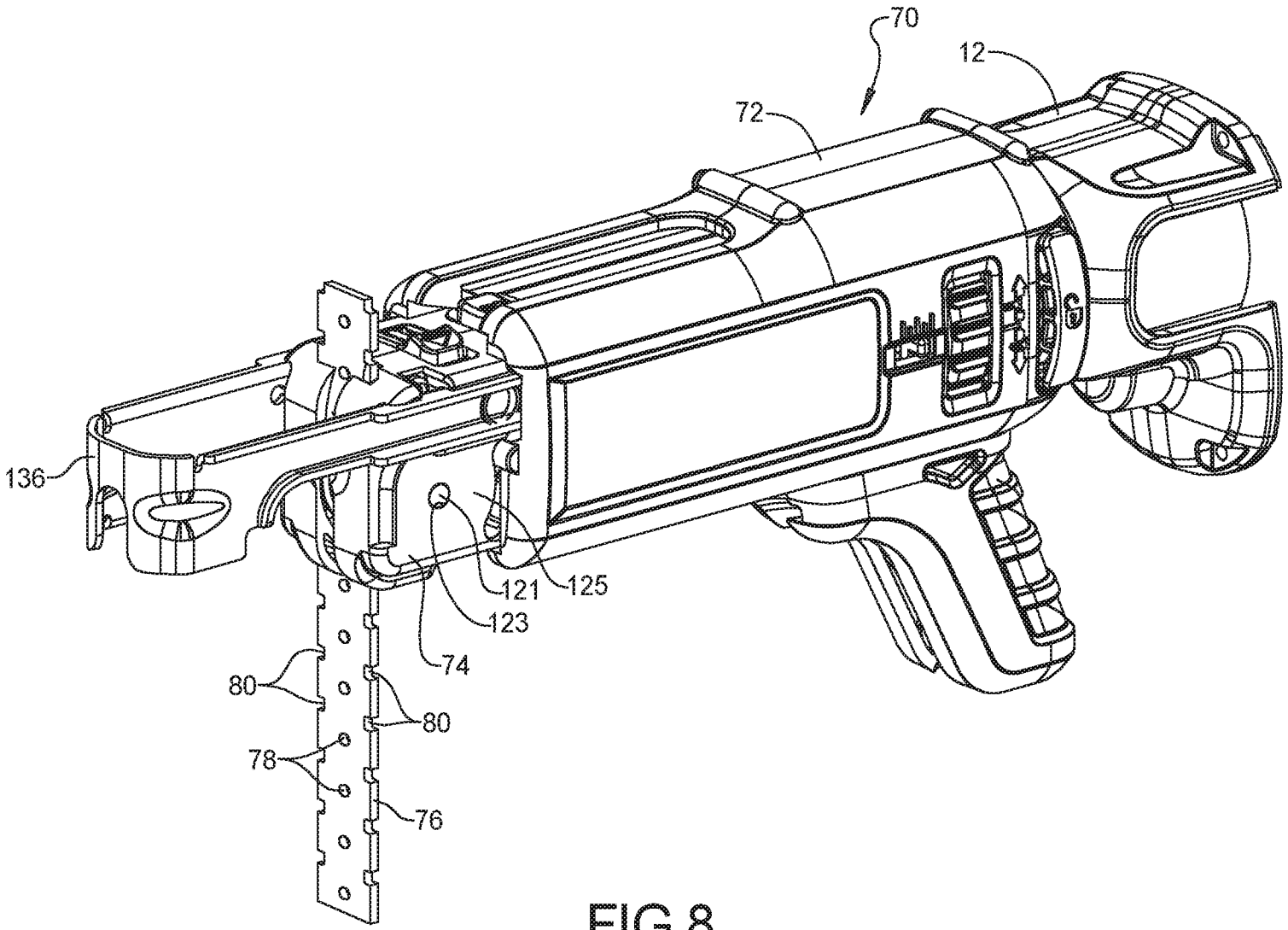
FIG. 8 is a perspective view of a magazine for feeding collated screws to a power screwdriver.

With reference to FIG. 8, a collated magazine attachment 70 is shown attached to the driving tool 12. The collated attachment includes a housing 72 and an advancing mechanism 74 which is slidably received within the housing 72. The advancing mechanism 74 is capable of receiving a collated strip of screws 76. It is noted that in FIG. 8, the strip 76 is shown with the screws omitted for illustrative purposes. The strip 76 includes a plurality of apertures 78 that receive the screws therethrough. The edges of the strip 76 include rectangular slots 80 on each side which are evenly spaced.

Figure 9:
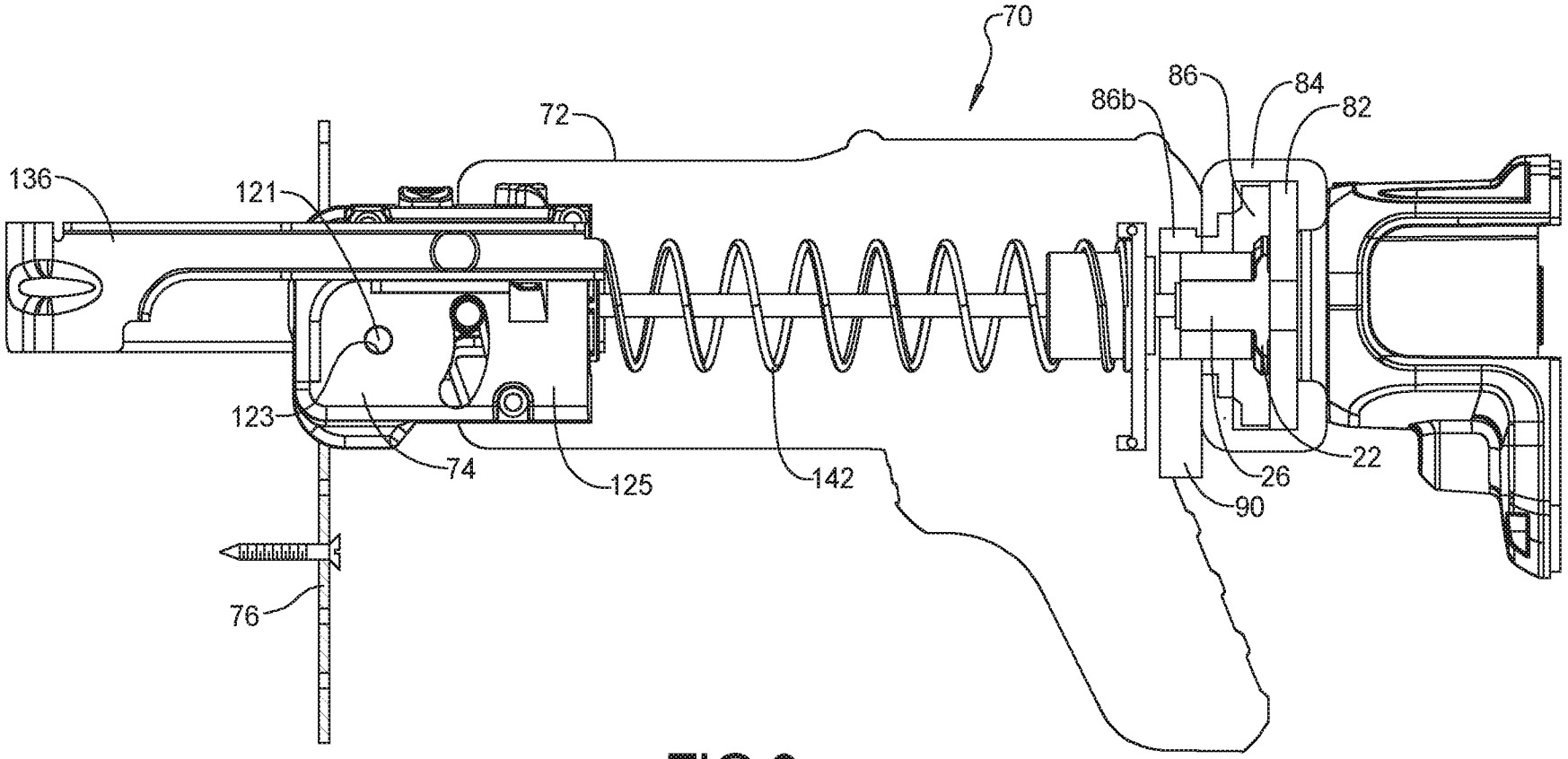
FIG. 9 is a cross-sectional view of the magazine of FIG. 8.
Figure 9A:
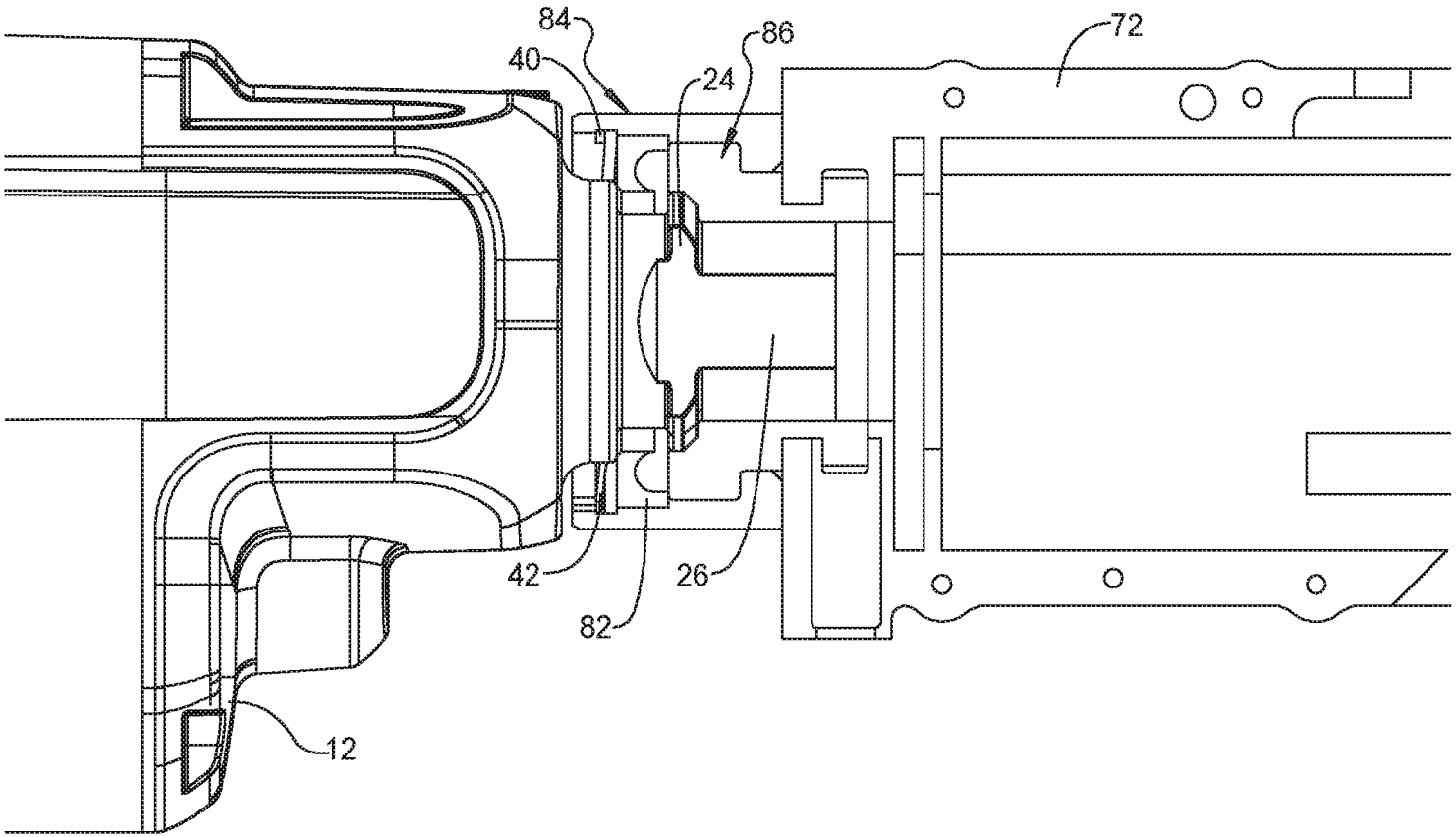
FIG. 9A is a side view, partially in section, illustrating an attachment mechanism for attaching the magazine of FIG. 8 to a power screwdriver.
Figure 9B:
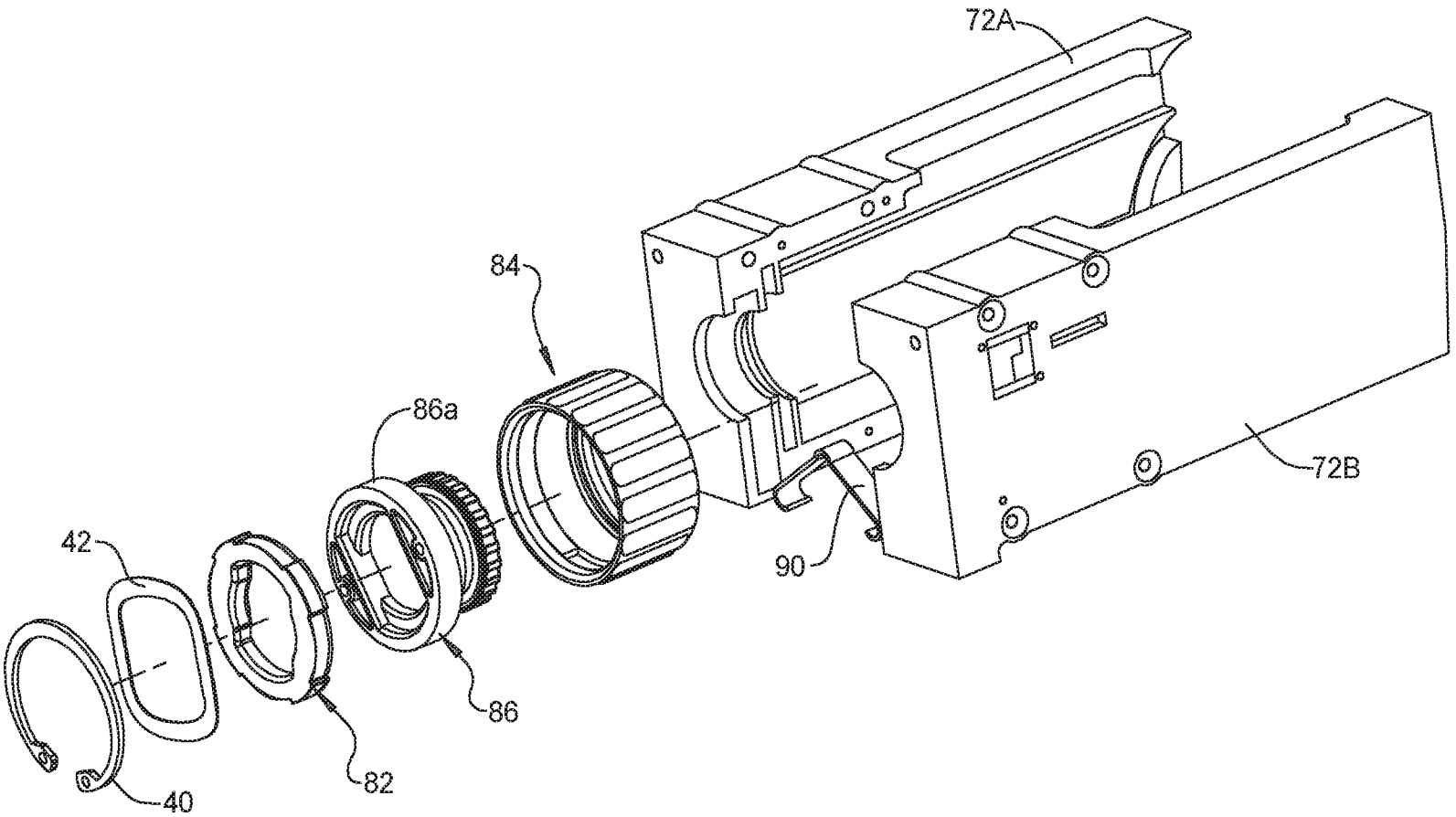
FIG. 9B is an exploded view of the attachment mechanism of FIG. 9A.

As shown in FIGS. 9-9B, the collated attachment 70 is attached to the gear case 22 of the driving tool 12 by a bayonet connection including a lock disc 82 that rotates with a lock collar 84. As shown in FIG. 9B, the housing 72 can be formed of two clamshell halves 72A, 72B that can be secured together by fasteners, rivets, heat welding, adhesives, or other known attachment techniques.

Figure 10:
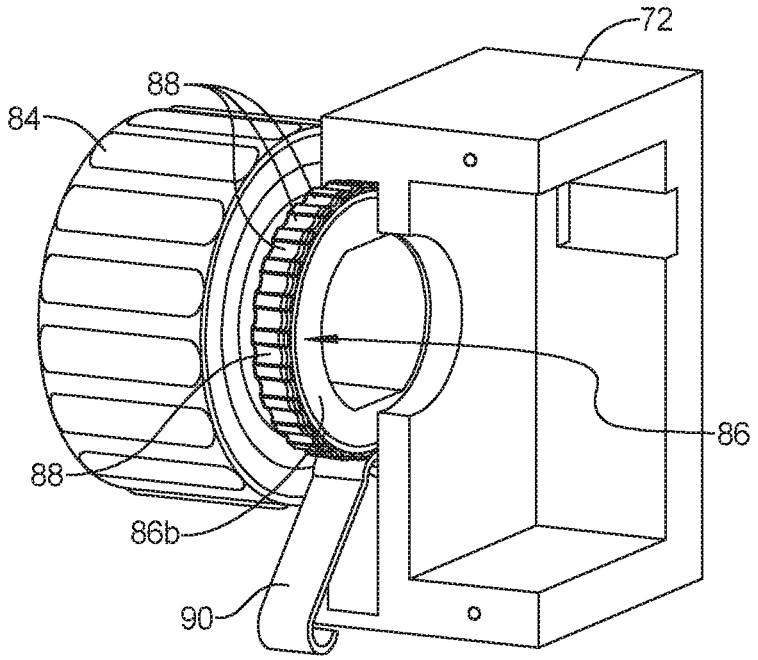
FIG. 10 is a perspective view of an indexing mechanism for the magazine of FIG. 8.
Figure 11:
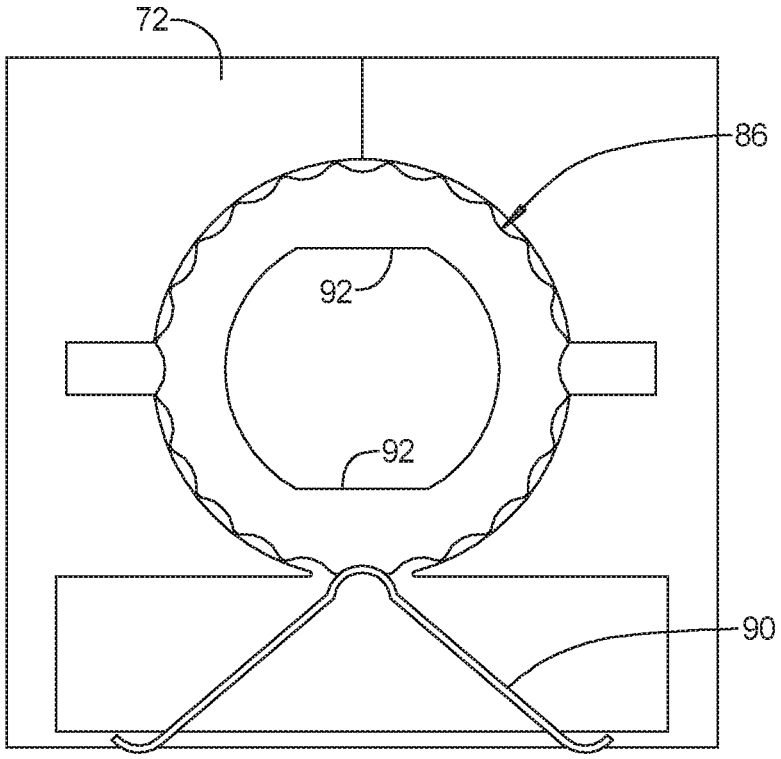
FIG. 11 is a cross-sectional view of the indexing mechanism of FIG. 10.

Referring to FIGS. 9B-11, the collated attachment 70 has an indexing mechanism that enables the collated attachment 70 to be rotated and indexed relative to the tool 12 without removing the attachment from the tool. The collated attachment 70 includes a detent featured ring or disc 86, best shown in FIG. 10, that has a rearward end 86*a* that seats against the lock disk or ring 82. A forward end 86*b* of the detent featured disc 86 includes a series of recessed detents 88 that are engaged with a leaf spring 90, as illustrated in FIGS. 10 and 11. The housing 72 as illustrated in FIGS. 9-11 supports the leaf spring 90 and can be rotated relative to the detent featured disc 86 in order to orient the collated attachment 70 in a desired rotational position relative to the driving tool 12. The leaf spring 90 holds the orientation of the housing 72 relative to the tool 12 until the user turns the housing 72 to a new desired position. It is noted that the detent featured disc 86 includes flats 92 on an interior surface thereof that engage with the flats 26 of the gear case 22 to prevent the detent featured disc 86 from being rotated relative to the driving tool 12. It is also noted that the housing 72 illustrated in FIG. 10 is only partially shown for illustrating the rotation of the housing 72 relative to the detent feature disk 86.

Figure 12:
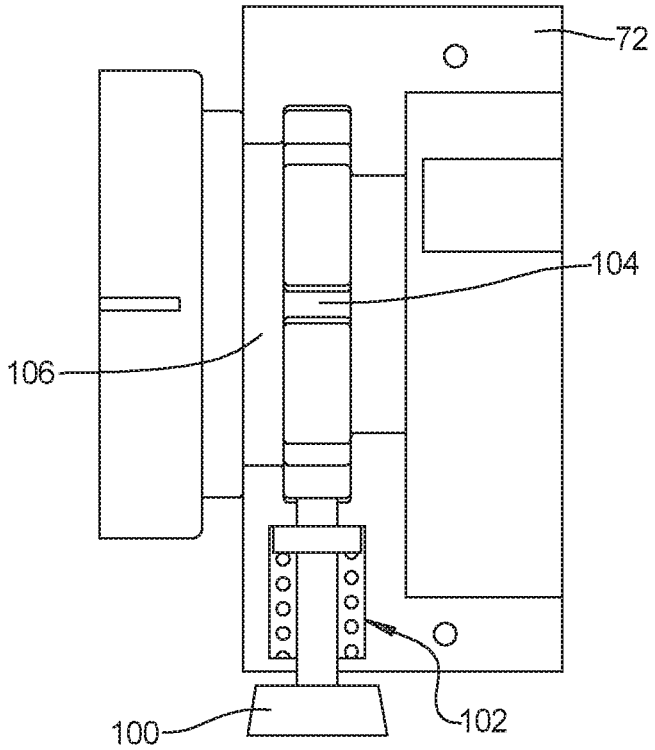
FIG. 12 is a side view of another embodiment of an indexing mechanism for the magazine of FIG. 8.
Figure 13:
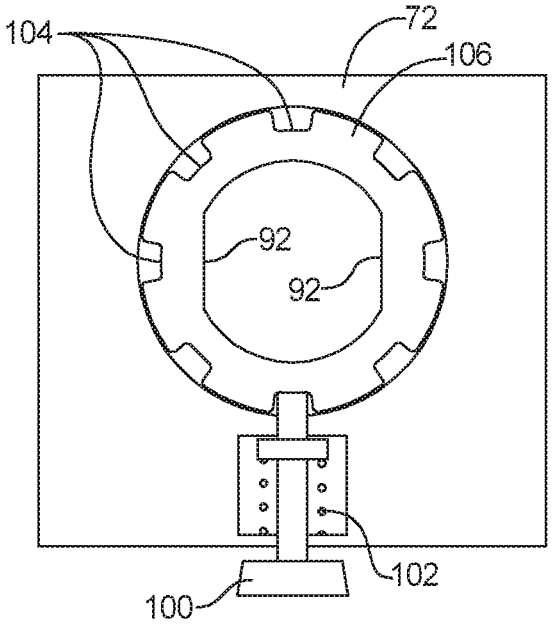
FIGS. 13 and 14 are cross-sectional views of the indexing mechanism of FIG. 12.
Figure 14:
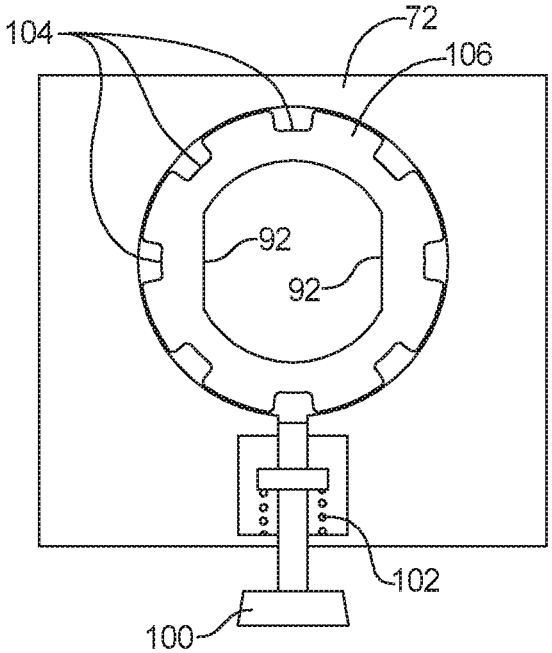

According to an alternative embodiment of the indexing mechanism, as illustrated in FIGS. 12-14, the housing 72 can support a lock pin 100 that is biased by a spring 102 into an engaged position with recessed dogs 104 of a lock disc 106. In this way, the lock pin 100 can be provided in the locked position as illustrated in FIG. 13 in order to positively prevent the housing 72 from rotating relative to the gear case 22 of the driving tool 12. As illustrated in FIG. 14, when the lock pin 100 is pulled out of engagement with the dogs 104 against the biasing force of the spring 102, the housing 72 can be rotated relative to the lock disk 106 and thereby relative to the gear case 22 and the driving tool 12.

Figure 15:
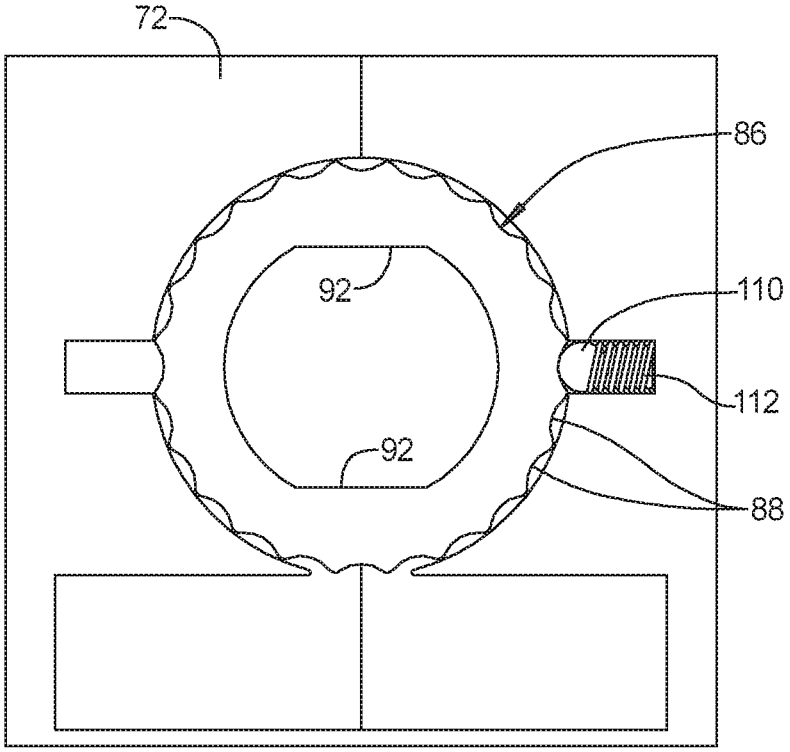
FIG. 15 is a cross-sectional view of another embodiment of an indexing mechanism for the magazine of FIG. 8.
Figure 16:
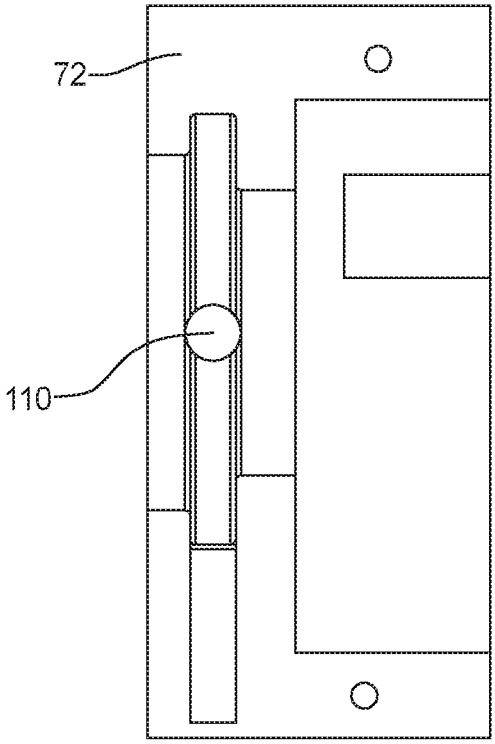
FIG. 16 is a side view of the indexing mechanism of FIG. 15.

According to a still further embodiment of the indexing mechanism, as illustrated in FIGS. 15 and 16, the housing 72 can be provided with a lock bolt 110 that can engage the detents 88 around the perimeter of the locked disk 86. The lock bolt 110 is biased by a spring 112 that provides resistance against rotation of the housing 72 relative to the lock disk 86. When sufficient force is applied to rotate the housing 72 of the collated attachment 70, the lock bolt 110 is pushed rearward sufficiently to allow the housing 72 to be rotated relative to the lock disk 86 and thereby relative to the gear case 22 and the driving tool 12. The above described FIGS. 11-16 provide alternative methods of allowing the collated attachment 70 to be rotated relative to the tool 12 without removing the attachment 70 from the tool 12.

Figure 17:
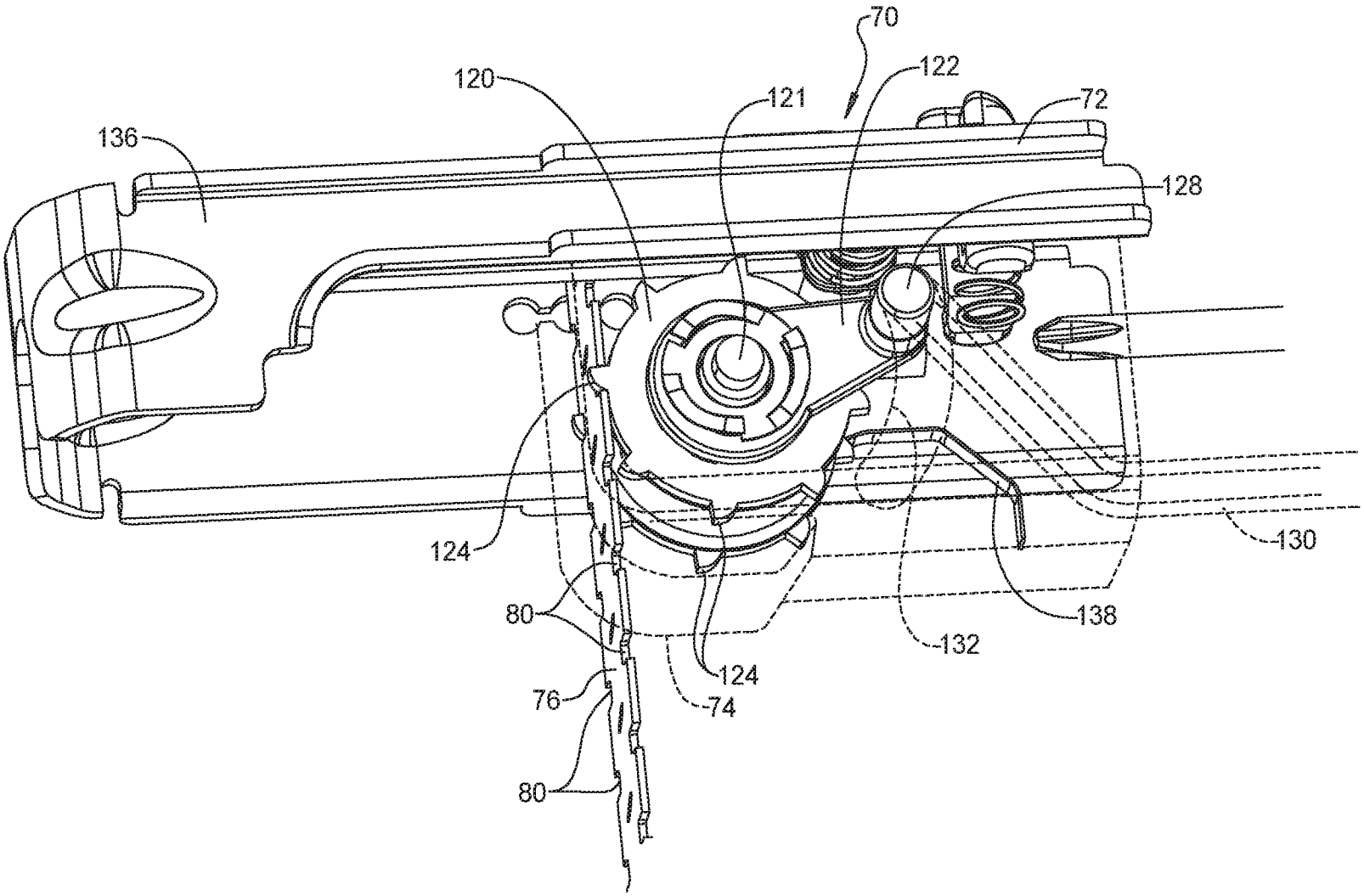
FIGS. 17-19 are perspective views, partially transparent, of an advancing mechanism for the magazine of FIG. 8.
Figure 18:
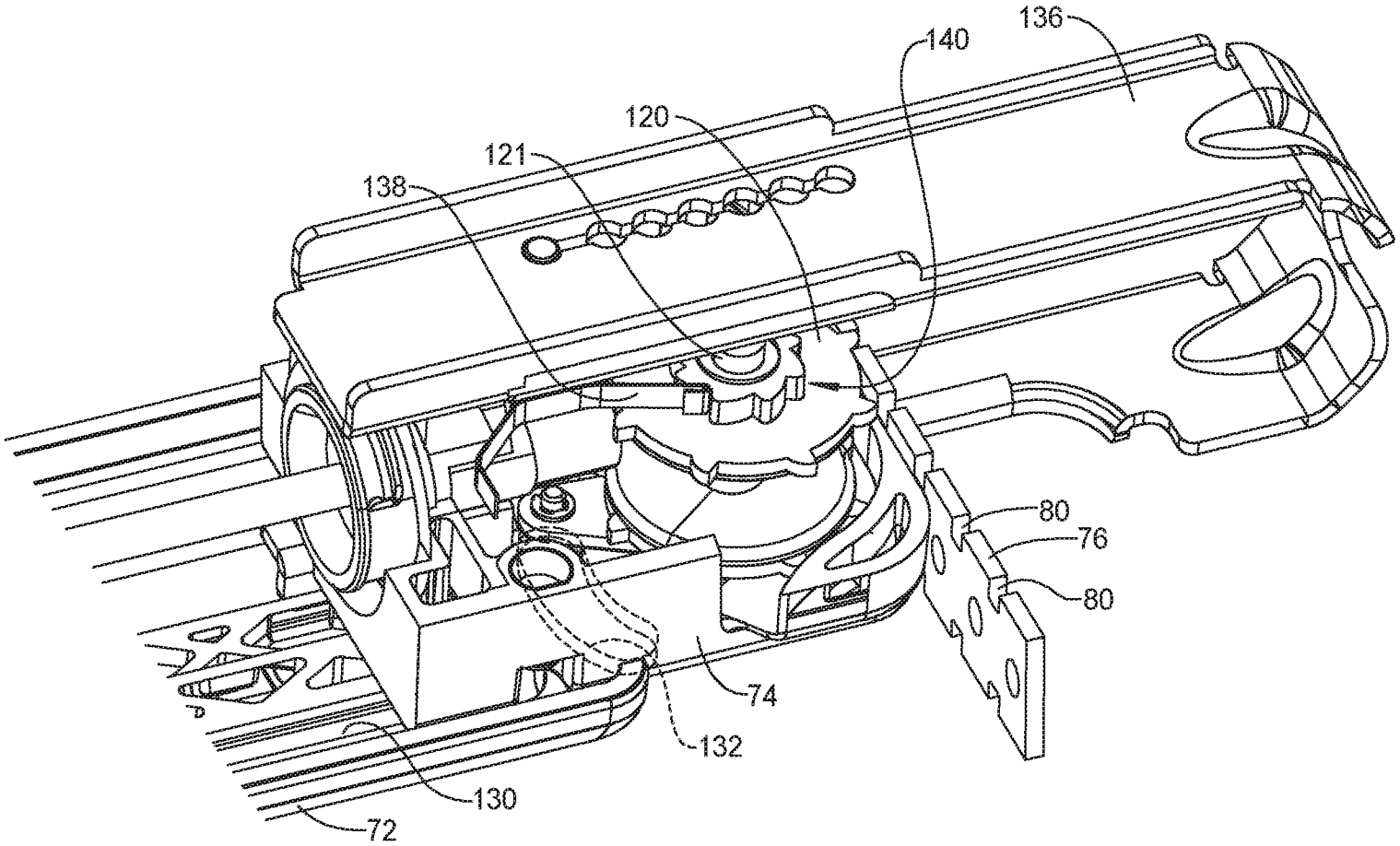
Figure 19:
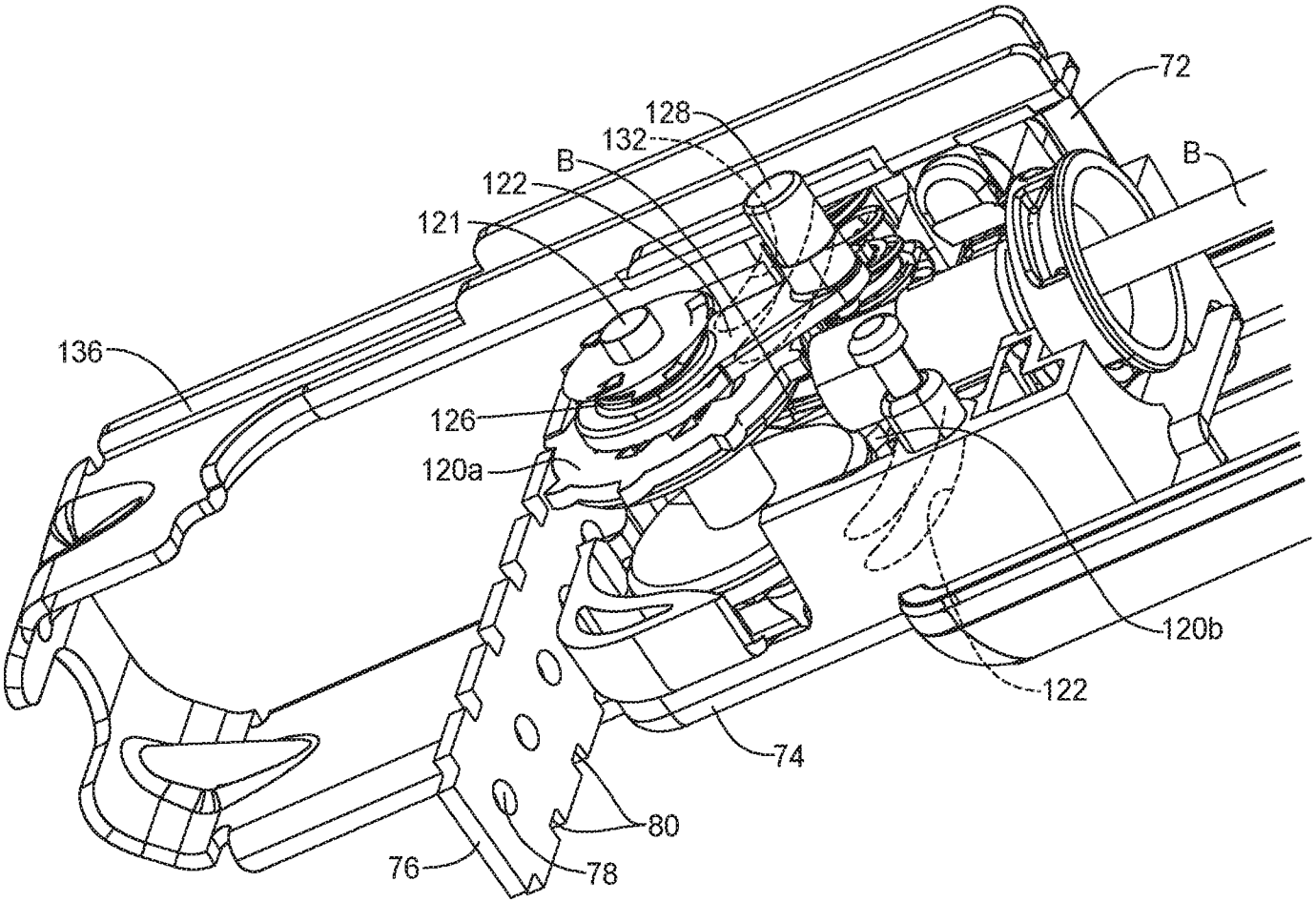

Referring to FIGS. 17-19, the collated attachment 70 includes advancing mechanism 74 for automatically advancing the collated screw strip 76 through the collated attachment 70 while it is attached to the driving tool 12. On the inward and outward strokes of the driving tool 12, the advancing mechanism 74 advances the collated strip 76 then resets itself. It should be noted that in FIGS. 17-19, the structure of the some of the components of the advancing mechanism and housing are shown as three-dimensional transparent components so that the function and operation of the various components can be illustrated.

With reference to FIGS. 17-19, the advancing mechanism 74 rotatably supports an advancing cog 120 and a clutch arm 122. The advancing cog 120 includes a pair of laterally spaced cog wheels 120*a*, 120*b* each with a plurality of circumferentially spaced cog teeth 124 which engage the rectangular slots 80 in the sides of the collated strip 76. The advancing cog 120 is rotatably supported by integrally formed shaft ends 121 received in apertures 123 in a housing 125 of the advancing mechanism 74. The cog wheels 120*a*, 120*b* are rotated in an advancing direction by the clutch arm 122 and by a clutch mechanism 126 provided between the clutch arm 122 and a side face of one of the cog wheels 120*a*. A clutch spring can bias the clutch feature 126 of the clutch arm 122 against the clutch feature 126 of the cog 120. The clutch arm 122 is pivotally mounted on one of the shaft ends 121 of the advancing cog 120 and includes a guide pin 128 that is received in a drive slot 130 provided on the interior of the housing 72. The guide pin 128 is also received in an arcuate slot 132 provided on the advancing mechanism 74.

The advancing mechanism 74 includes a shoe 136 that engages a workpiece and presses the advancing mechanism 74 inward relative to the housing 72 during a screwing operation. As the advancing mechanism 74 is pushed axially into the housing 72, the guide pin 128 follows the drive slot 130 and arcuate slot 132 to cause the clutch arm 122 to pivot in the direction indicated by the arrow shown in FIG. 17. As the clutch arm 122 pivots, the clutch mechanism 126 between the clutch arm 122 and advancing cog 120*a* causes the advancing cogs 120*a*, 120*b* to rotate along with the clutch arm 122. As the advancing cog 120 is rotated, the collated screw strip 76 is advanced to properly align a new screw with the drill bit B which is being brought into engagement with the head of the screw as the shoe 136 is pressed against a workpiece. As illustrated in FIG. 18, a fixed pawl 138 engages ratchet teeth 140 formed on the advancing cog 120 to prevent the advancing cog 120 from rotating in a reverse direction.

With reference to FIG. 9, a return spring 142 is provided for biasing the advancing mechanism 74 towards a forward portion of the housing 72 of the collated attachment 70. Thus, after a screw is driven into a workpiece wherein the shoe 136 is pressed against the workpiece and the advancing mechanism 74 is pushed rearward into the housing 72, the return spring 142 causes the advancing mechanism 74 to move to its forward position wherein the clutch arm 122 is returned to the position as illustrated in FIG. 17. At this time, there is no screw aligned with the driver bit B until the shoe 136 is then pressed against a workpiece and the tool 12 is pushed forward thereby causing the advancing mechanism 74 to be pushed rearward into the housing 72 thereby causing rotation of the clutch arm 122 to cause rotation of the advancing cog 120 to advance the collated screw strip 76 to align a new screw with the bit B.

The clutch mechanism 126 between the clutch arm 122 and the cog 120 only causes engagement in the advancing direction, and is allowed to provide relative movement between the clutch arm 122 and advancing cog 120 when the clutch arm 122 is moved back to its starting position. Likewise, the ratcheting teeth 140 on the advancing cog 120 are allowed to rotate in the advancing direction relative to the pawl 138, while the pawl 138 will prevent backward rotation of the advancing cog 120 by engaging the ratchet teeth 140. With this design, the shaft ends 121, the ratchet teeth 140, and clutch teeth 126 can be formed integrally with the advancing cog 120 whereas corresponding clutch members 126 are provided on the clutch arm 122, and the clutch arm 122 is biased axially towards the clutch teeth 126 on the advancing cog 120 by a spring.

Figure 20:
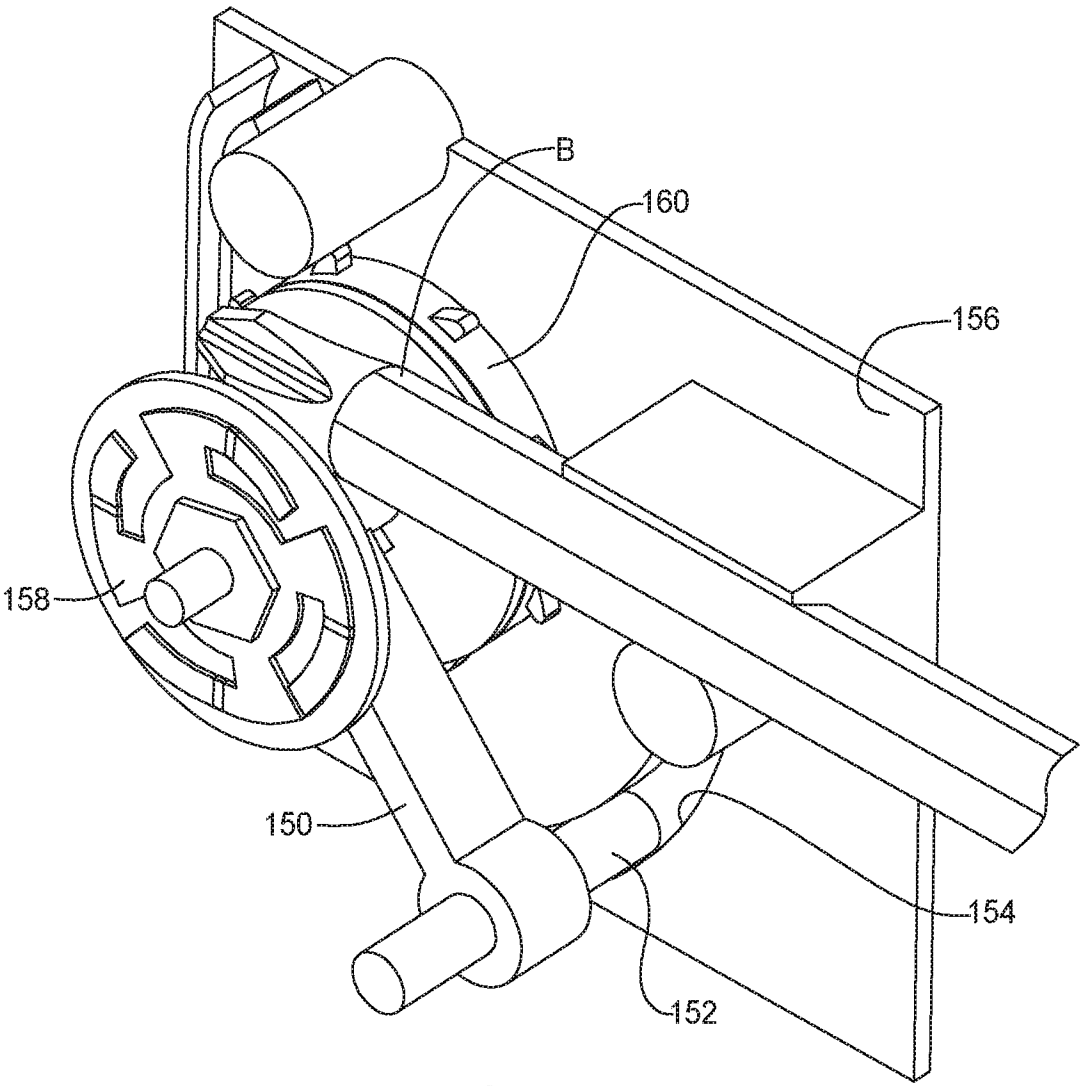
FIGS. 20-23 are perspective views of another embodiment of an advancing mechanism for the magazine of FIG. 8.
Figure 21:
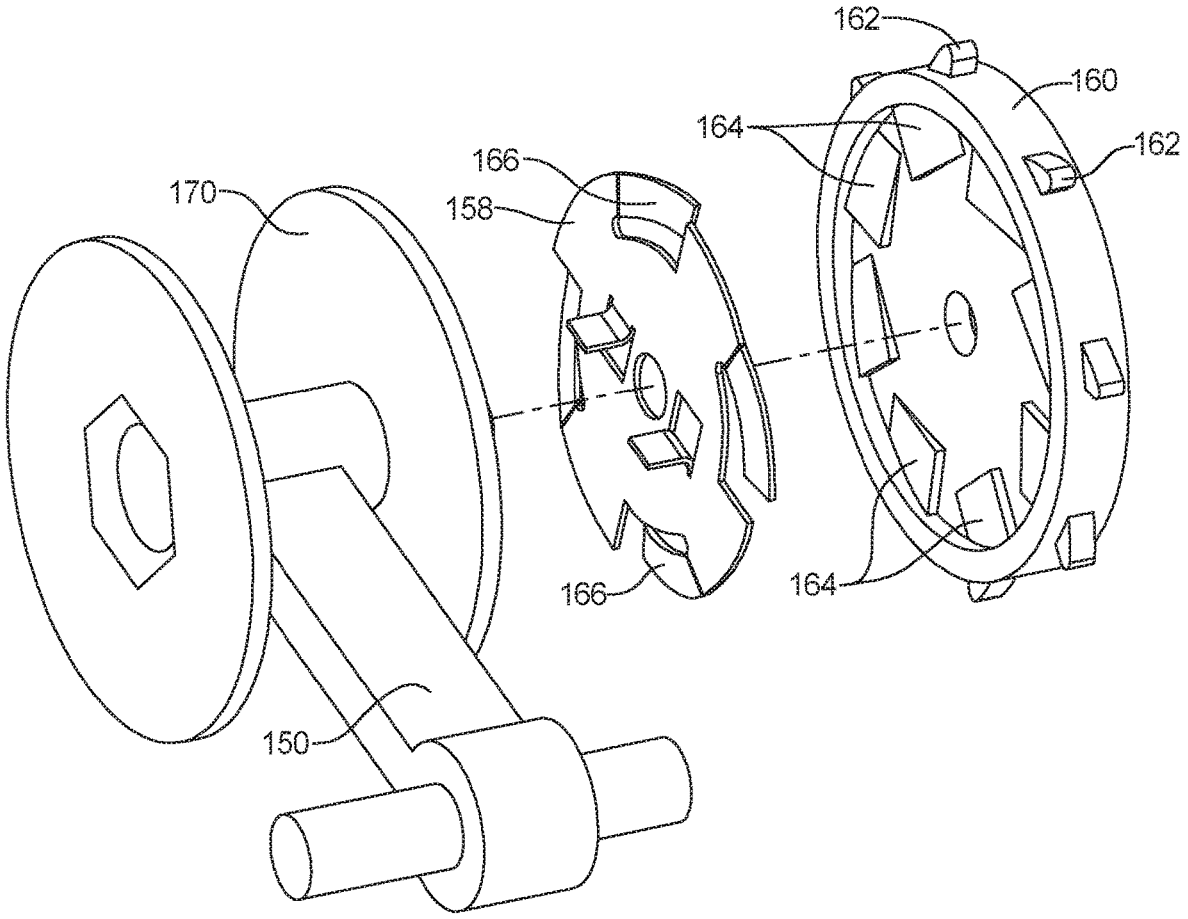

With reference to FIGS. 20-23, an alternative embodiment of an advancing mechanism 74' is shown having an alternative arrangement of a clutch arm 150 and advancing cog 160. With reference to FIG. 20, the clutch arm 150 is shown including a guide pin 152 that is movable within an arcuate clearance slot 154 in the housing 156 of the advancing mechanism 74, and that also engages a similar guide slot 130 of the housing 72 (previously described). The clutch arm 150 includes a pair of clutch springs 158 which each engage a cogwheel 160, only one of which is shown in FIGS. 20 and 21. With reference to FIG. 21, an exploded view of the clutch spring 158 and clutch arm 150 are provided along with a cogwheel 160. The cogwheel 160 includes advancing teeth 162 on an outer peripheral surface which engage the rectangular slots 80 provided in the edges of the collated screw strip 76. The axial face of the cogwheel 160 is provided with clutch teeth 164 which engage with the clutch spring 158. The clutch spring 158 includes spring arms 166 which deliver rotation from the clutch arm 150 in one direction to the cogwheel 160.

Figure 23:
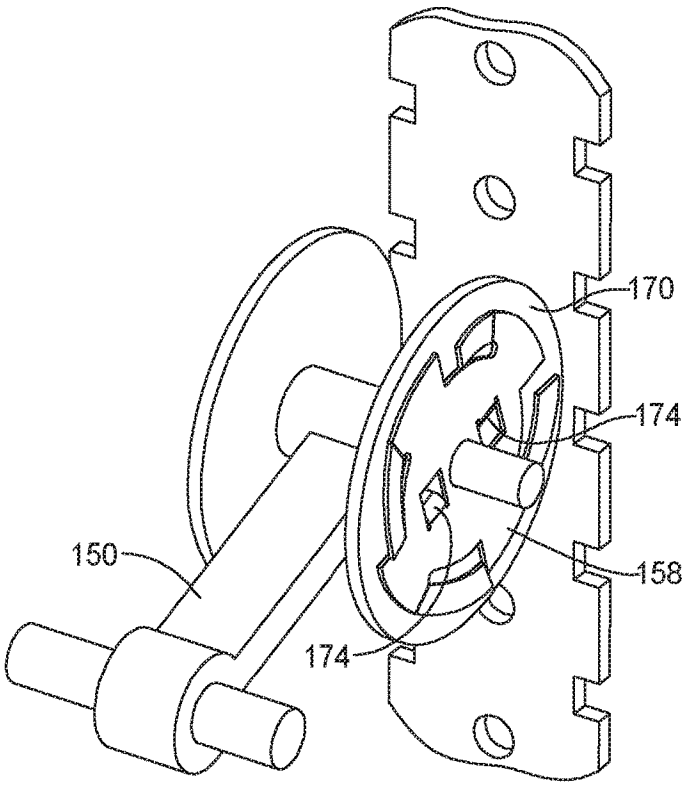
Figure 22:
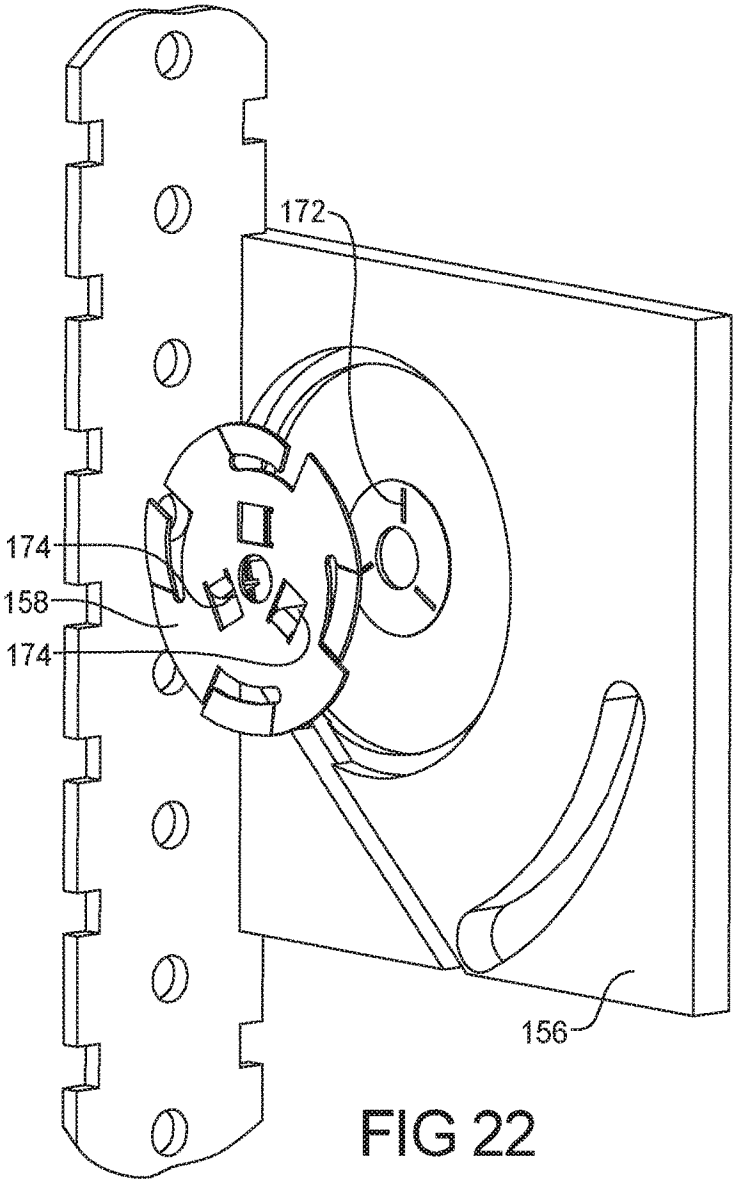

With reference to FIGS. 22 and 23, the assembly of the clutch spring 158 to a hub 170 of the clutch arm and to a sidewall of the housing 156 will now be described. As illustrated in FIG. 22, the sidewall of the housing 156 includes mounting features such as slots 172. The clutch spring 158 includes bent tabs 174 which are inserted into the slots 172 for retaining the clutch spring 158 to the sidewall of the housing 156 of the advancing mechanism 74. As shown in FIG. 23, the hub 170 of the clutch arm 150 can also be provided with similar slots for receiving bent tabs 174 for retaining the clutch spring 158 to the hub 170 of the clutch arm 150. Therefore, the clutch spring 158 mounted to the clutch arm 150 provides a driving torque to the advancing cogs 160 when rotated in a first direction, and do not provide any rotation when the clutch arm 150 is rotated in the reverse direction. The clutch spring 158 that is mounted to the sidewalls of the housing 156 of the advancing mechanism 74 prevent the advancing cog 160 from rotating in a reverse direction so that the screw strip 176 is securely fixed for alignment with the drill bit B until the screw is properly installed. The clutch springs 158 are internal to the cogwheels 160 and are fixed to the clutch arm 150, allowing the clutch arm 150 to drive in an advancing direction but clutching while the clutch arm 150 rotates to its beginning position.

Figure 24:
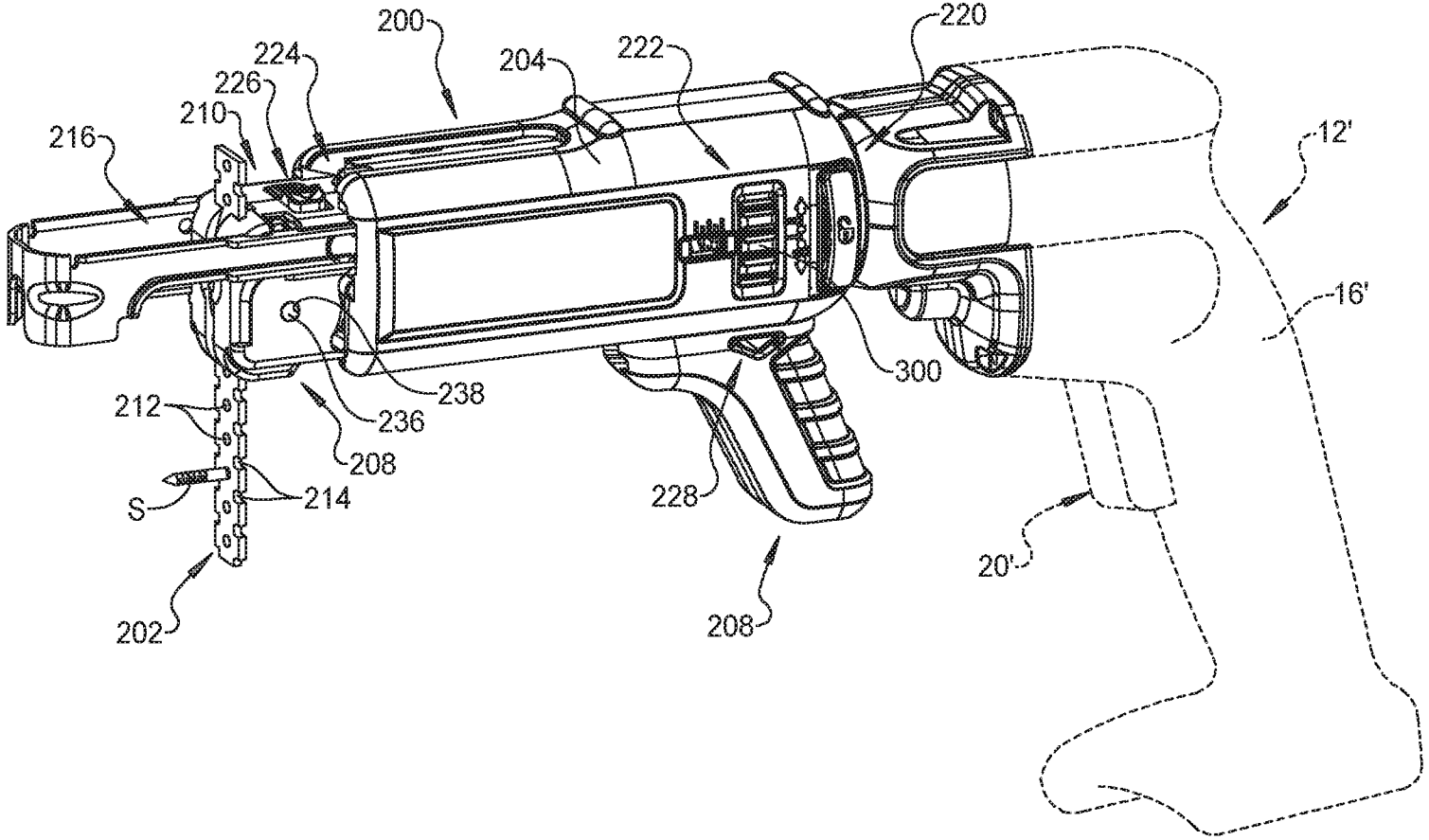
FIG. 24 is a perspective view of another embodiment of a power screwdriver and another embodiment of a magazine for feeding collated screws to the screwdriver.

With reference to FIG. 24, another embodiment of a drywall screw gun 12' is shown having a collated attachment 200 that enables a strip of collated screws 202 to be fed automatically to be aligned with and driven by a screwdriver bit coupled to the screw gun 12'. The drywall screw gun 12' is similar to the previously described driving tool 12, and can include a housing 16' which houses a motor and gear case. A long screw bit 18' (FIG. 25) can be drivingly connected to a tool holder in the screw gun 12'. A trigger 20' is provided to actuate the motor to drive the screw bit 18'. The screw gun 12' can be battery-operated or can include a cord for supplying electricity to the motor.

The collated attachment 200 can include a housing 204 that can include a handle 206 extending therefrom. A shoe 208 is reciprocally supported by the housing 204 and includes an advancing mechanism 210 for automatically advancing the strip of collated screws 202 after each screwing operation to bring a new screw into alignment with the screw bit 18'. The strip of collated screws 202 includes a plurality of apertures 212 that receive the screws S (only one of which is shown) therethrough. The edges of the strip 202 include rectangular slots 214 on each side which are evenly spaced. A nosepiece 216 is provided for engaging a workpiece and is slidably received in the housing 204 along with the shoe 208. An attachment mechanism 220 is provided for attaching the collated attachment 200 to the drywall screw gun 12'. A fine depth adjustment device 222 is provided within the housing 204 for adjusting a depth of movement of the nosepiece 216 and shoe 208 within the housing 204. A push button shoe release 224 is provided for allowing the shoe 208 to be removed from the housing 204. A nosepiece depth adjustment device 226 is provided for allowing larger incremental depth adjustment of the nosepiece 216. Dust egress slots 228 are provided in the housing 204 to allow dust within the housing to escape.

Figure 25:
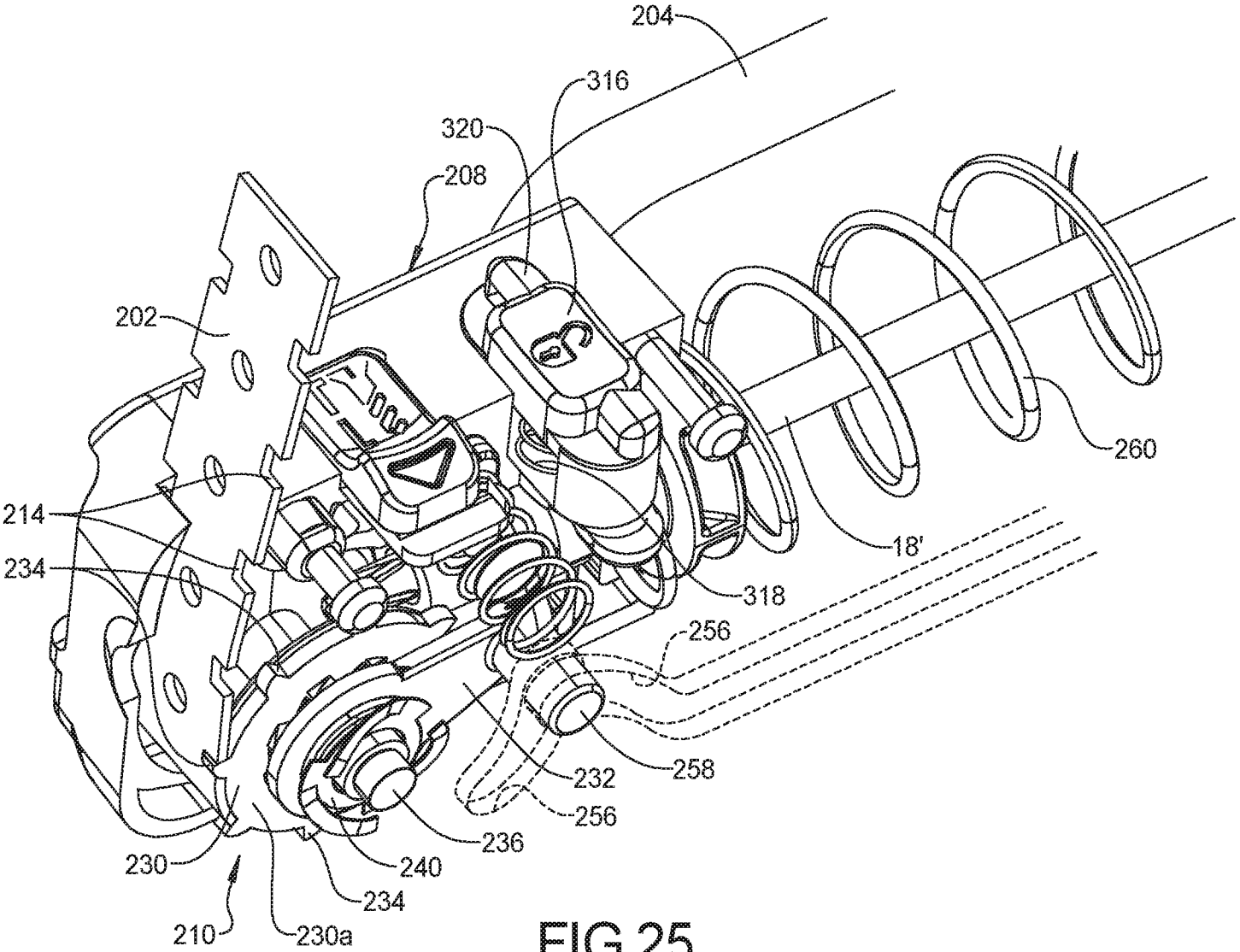
FIGS. 25-30 are perspective views, some partially transparent, of an advancing mechanism for the magazine of FIG. 24.
Figure 26:
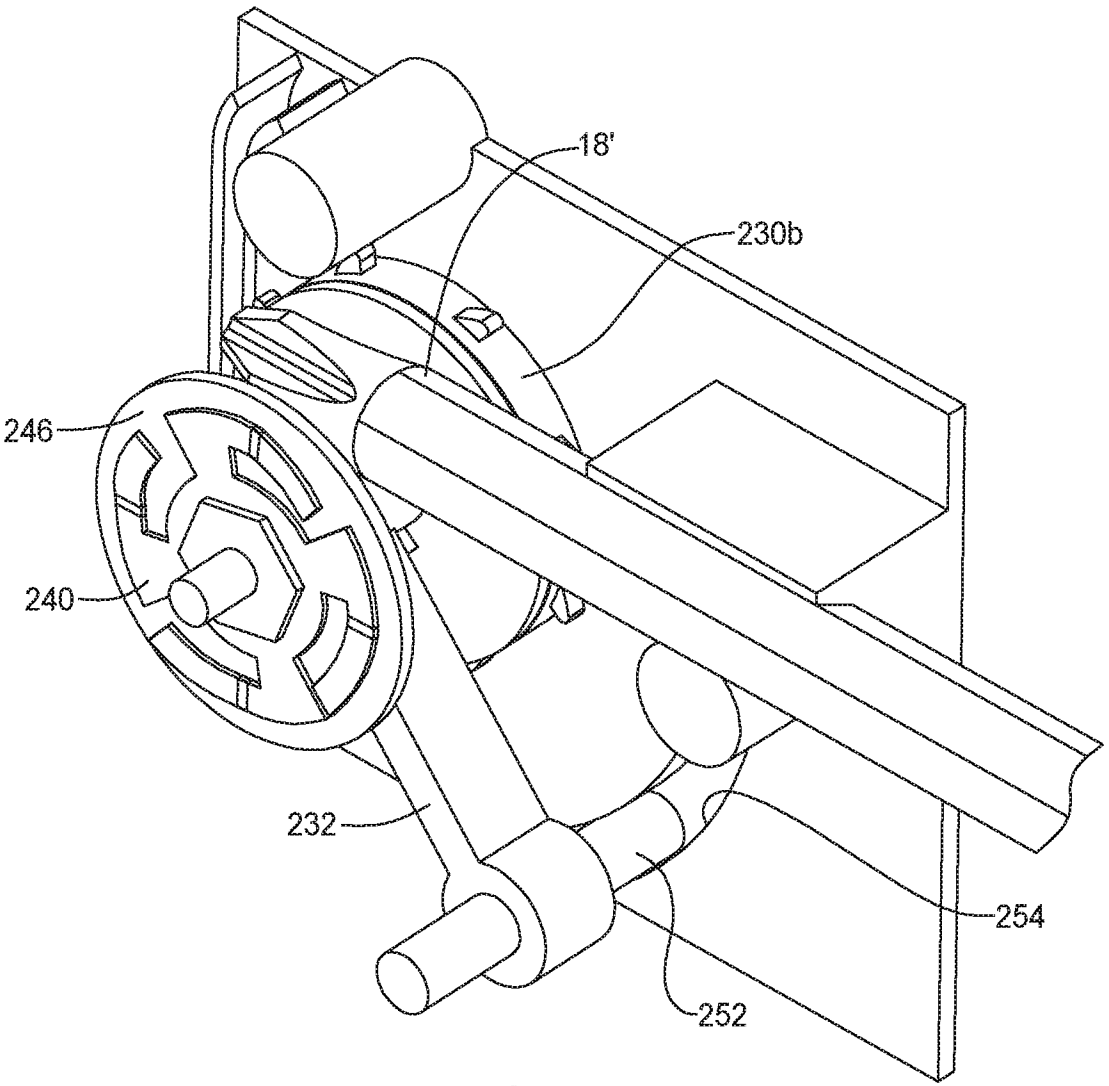
Figure 27:
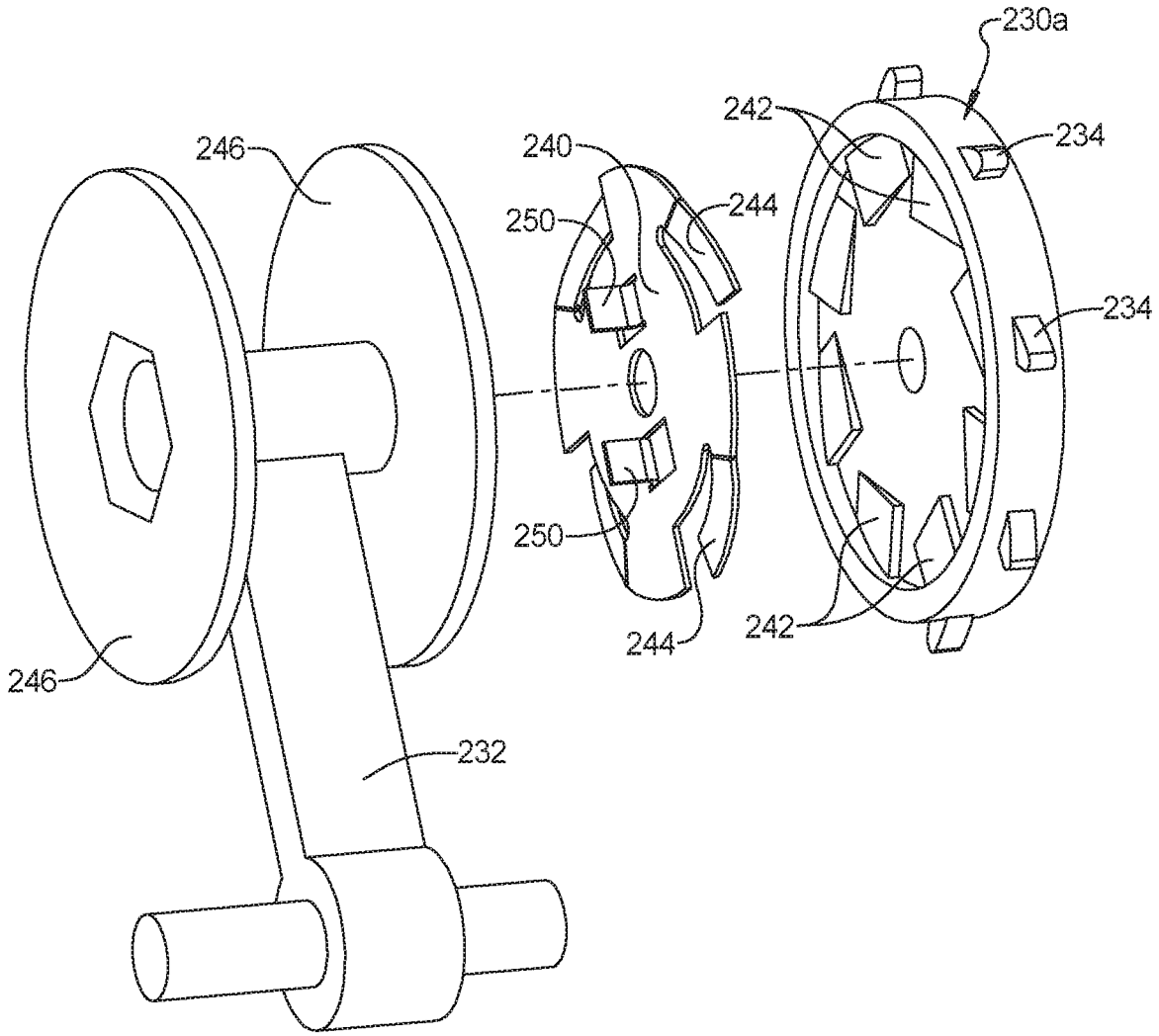

With reference to FIGS. 25-29, the advancing mechanism 210 within a forward portion of the shoe 208 will now be described. The advancing mechanism 210 is as an alternative embodiment of the previously described advancing mechanisms in FIGS. 17-23. It is noted that in FIG. 25, a portion of the shoe 208 and the housing 204 have been removed in order to illustrate the components of the advancing mechanism 210. The advancing mechanism 210 includes an advancing cog 230 and a clutch arm 232. The advancing cog 230 includes a pair of laterally spaced cogwheels **230*a*, 230*b* each with a plurality of circumferentially spaced cog teeth 234 which engage the rectangular slots 214 in the sides of the collated strip 202. The advancing cog 230 is rotatably supported by integrally formed shaft ends 236 received in apertures 238 (best shown in FIG. 24) in the shoe 208. The cogwheels 230*a*, 230*b* are rotated in an advancing direction by the clutch arm 232 and by a pair of clutch springs 240 which each engage a cogwheel 230*a*, 230*b* (only one of which is shown in FIG. 25). With reference to FIG. 27, an exploded view of the clutch spring 240 and clutch arm 232 are provided along with a cogwheel 230*a*. The cogwheel 230*a* includes the advancing teeth 234 on an outer peripheral surface which engage the rectangular slots 214 provided in the edges of the collated screw strip 202. The axial face of the cogwheel 230***a* is provided with clutch teeth 242 which engage with the clutch spring 240. The clutch spring 240 includes spring arms 244 which deliver rotation from the clutch arm 232 in one direction to the cogwheel 230.

Figure 29:
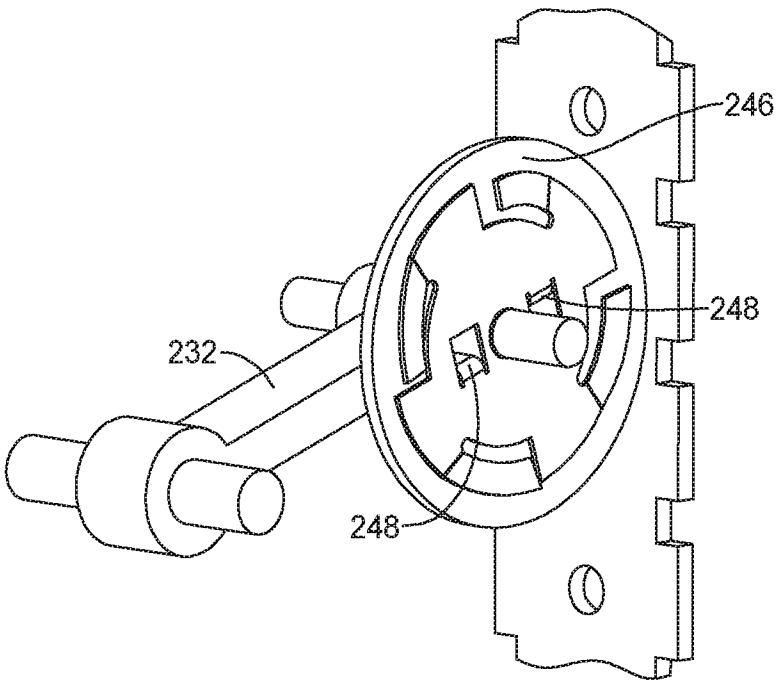
Figure 28:
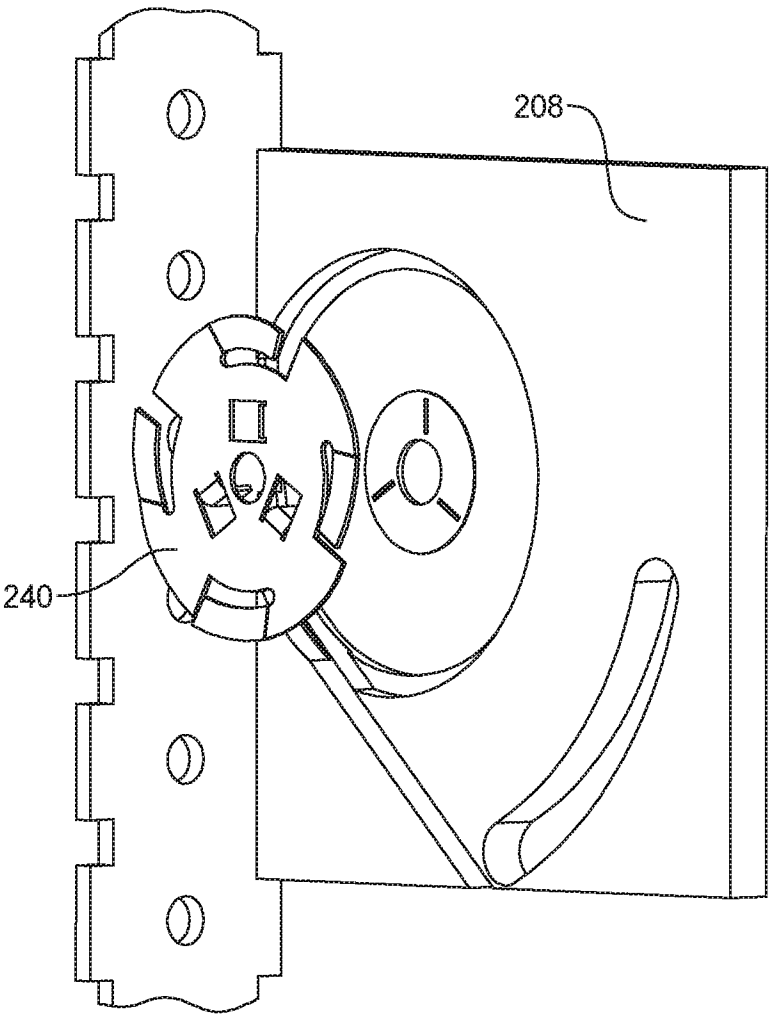
Figure 30:
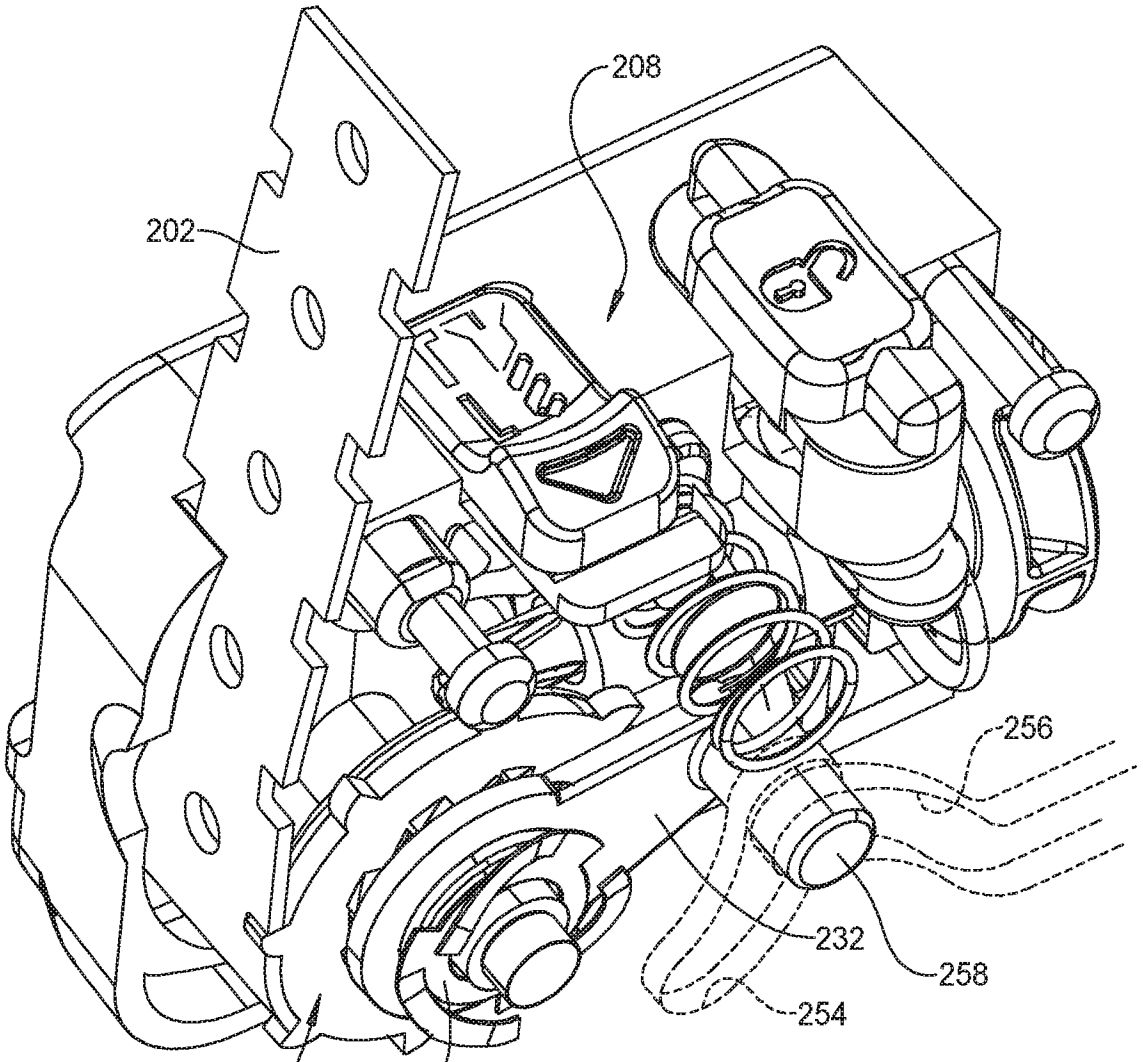

With reference to FIGS. 27-29, the assembly of the clutch spring 240 to a hub 246 of the clutch arm 232 will now be described. Hub 246 of the clutch arm 232 includes slots 248 which receive bent tabs 250 provided on the clutch spring 240 in order to down rotatably secure the clutch spring 240 to the hub 246 of the clutch arm 232. Therefore, the clutch spring 240 which is mounted to the clutch arm 232 provides a driving torque to the advancing cog's 230*a*, 230*b* by engagement with clutch teeth 242 on the axial face of the cogwheels 230*a*, 230*b*. The clutch springs 240 are internal to the cogwheels 230*a*, 230*b* and one of them is fixed to the clutch arm 232, while the other is fixed to a sidewall of the shoe 208 as shown in FIG. 28 to prevent reverse rotation of the cog 230, allowing the clutch arm 232 to drive in an advancing direction but clutching while the clutch arm 232 rotates to its beginning position.

The clutch arm 232 includes guide pins 252 which are movable within arcuate clearance slots 254 in the shoe 208 (FIG. 26) and also engage a similar guide slot 256 of the attachment housing 204 (FIG. 25). The nosepiece 216 and the shoe 208 of the advancing mechanism 210 engage a workpiece and press the advancing mechanism 210 inward relative to the housing 204 during a screwing operation. As the advancing mechanism 210 is pushed axially into the housing 204, the guide pins 252 simultaneously follow the arcuate clearance slots 254 and the guide slots 256 to cause the clutch arm 232 to pivot in the direction indicated by the arrow "A" shown in FIG. 25. The end of the guide pin 252 is provided with a pivoting tip 258 that provides for smoother movement along the clearance slot 254 and guide slot 256. As the clutch arm 232 pivots, the clutch spring 240 between the clutch arm 232 and the advancing cog 230*a* causes the advancing cogs 230*a*, 230*b* to rotate along with the clutch arm 232. As the advancing cog 230 is rotated, the collated screw strip 202 is advanced to properly align a new screw S with the drill bit 18 which is being brought into engagement with the head of the screw as the nose piece 216 is pressed against a workpiece.

With reference to FIG. 25, a return spring 260 is provided for biasing the shoe 208 with the advancing mechanism 210 towards a forward portion of the housing 204 of the collated attachment 200. Therefore, after a screw is driven into a workpiece where the shoe 208 is pushed rearward into the housing 204, the return spring 260 causes the shoe 208 with the advancing mechanism 210 to move to its forward position wherein the clutch arm 232 is returned to the position as illustrated in FIG. 25. At this time, there is no screw aligned with the driver bit 18 until the nosepiece 216 and shoe 208 are pressed against a workpiece and the screw gun 12 is pushed forward thereby causing the advancing mechanism 210 to be pushed rearward into the housing 204 thereby causing rotation of the clutch arm 232 to cause rotation of the advancing cog 230 to advance the collated screw strip 202 to align a new screw S with the bit 18. The clutch mechanism 240 between the clutch arm 232 and the cog 230 only causes engagement in the advancing direction, and is allowed to provide relative movement between the clutch arm 232 and the advancing cog 230 when the clutch arm 232 is moved back to it starting position. Likewise, the ratcheting teeth on the advancing cog 230 are allowed to rotate in the advancing direction while the second clutch spring 240 mounted to the side of the shoe 208 prevents the cog 230 from rotating in reverse.

Figure 31:
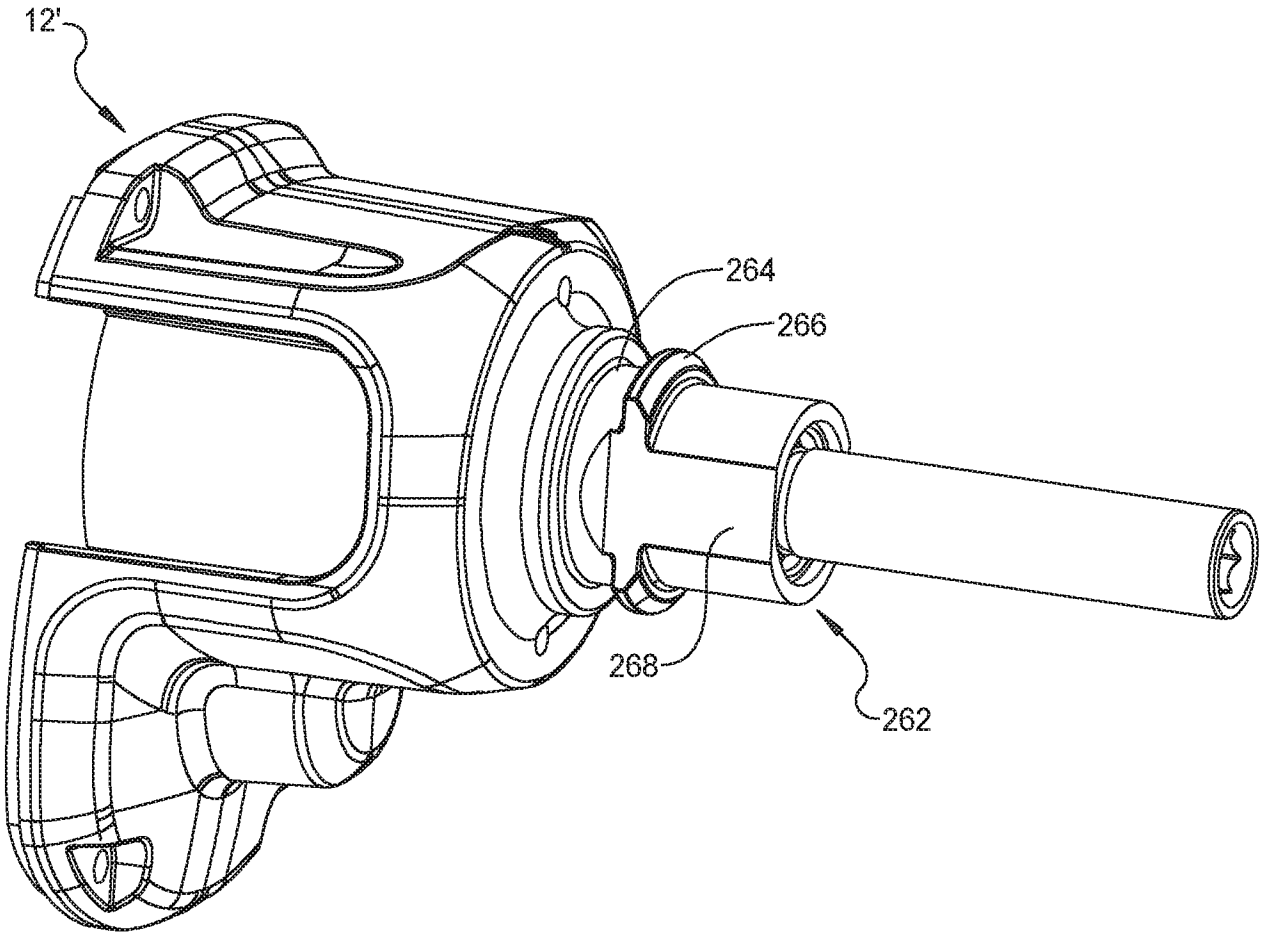
FIG. 31 is a perspective view of an attachment mechanism for the screwdriver of FIG. 24.
Figure 32:
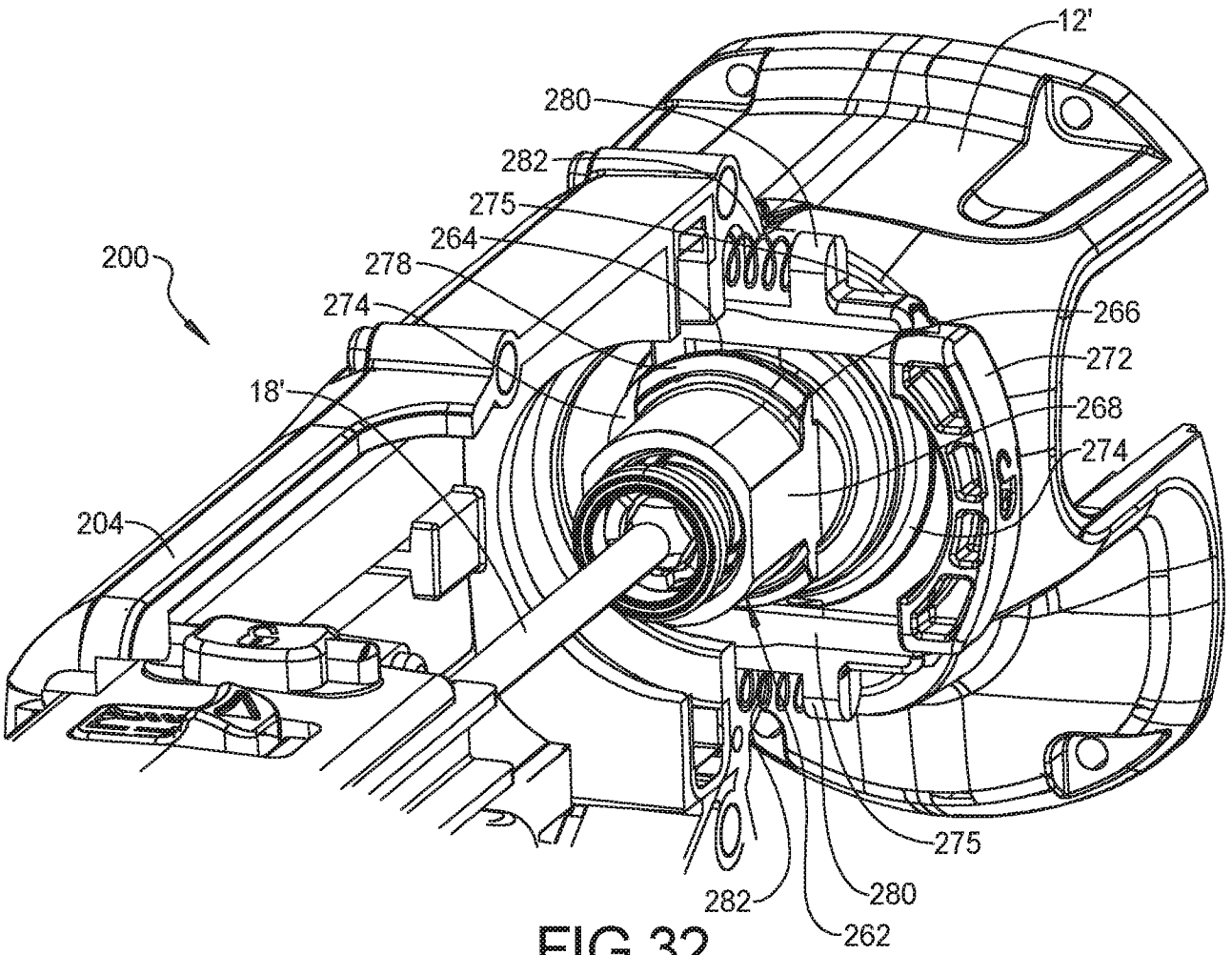
FIGS. 32-34 are perspective views, partially in section, of an attachment mechanism of the magazine of FIG. 24 for coupling the magazine to the screwdriver of FIG. 24.
Figure 33:
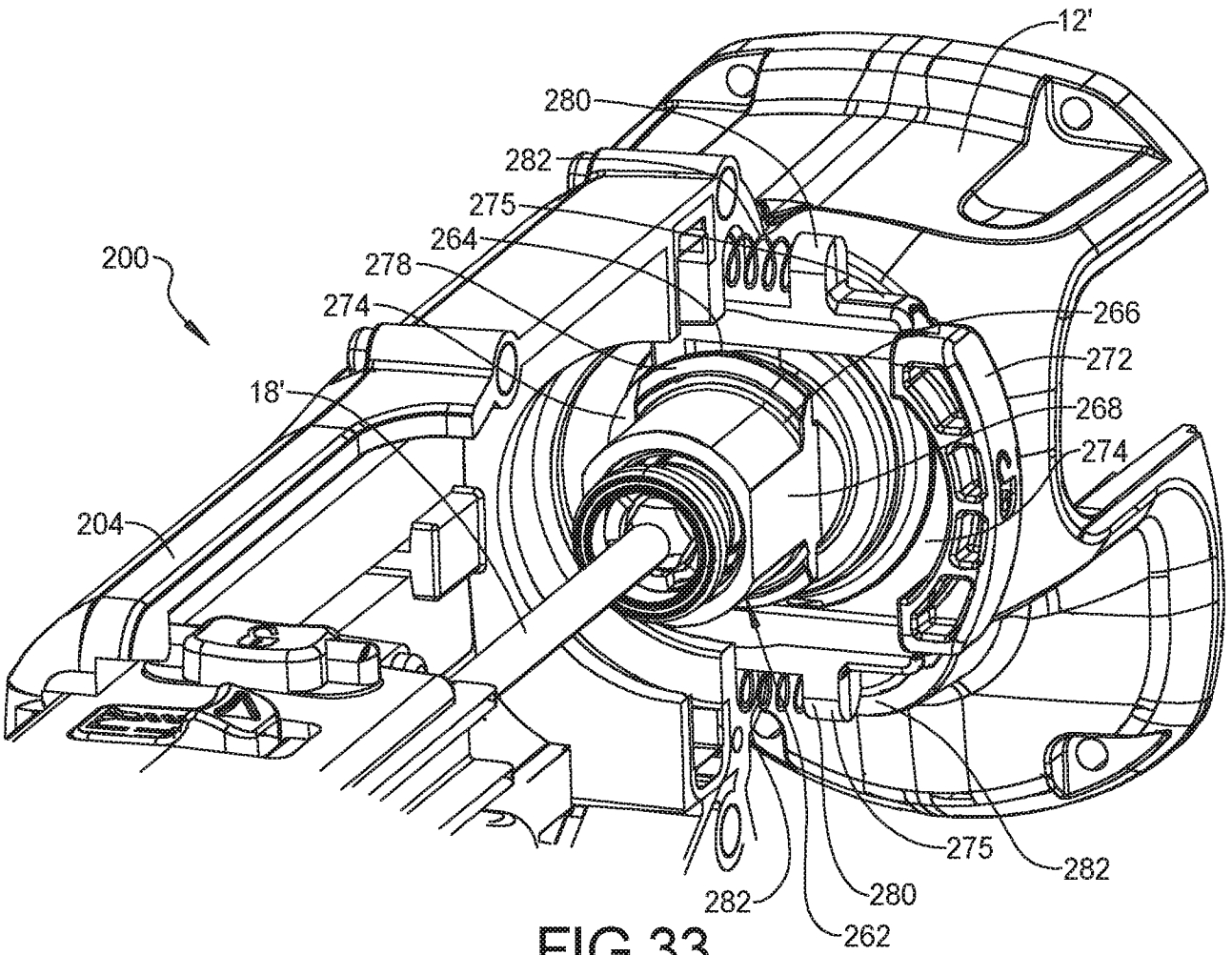
Figure 34:
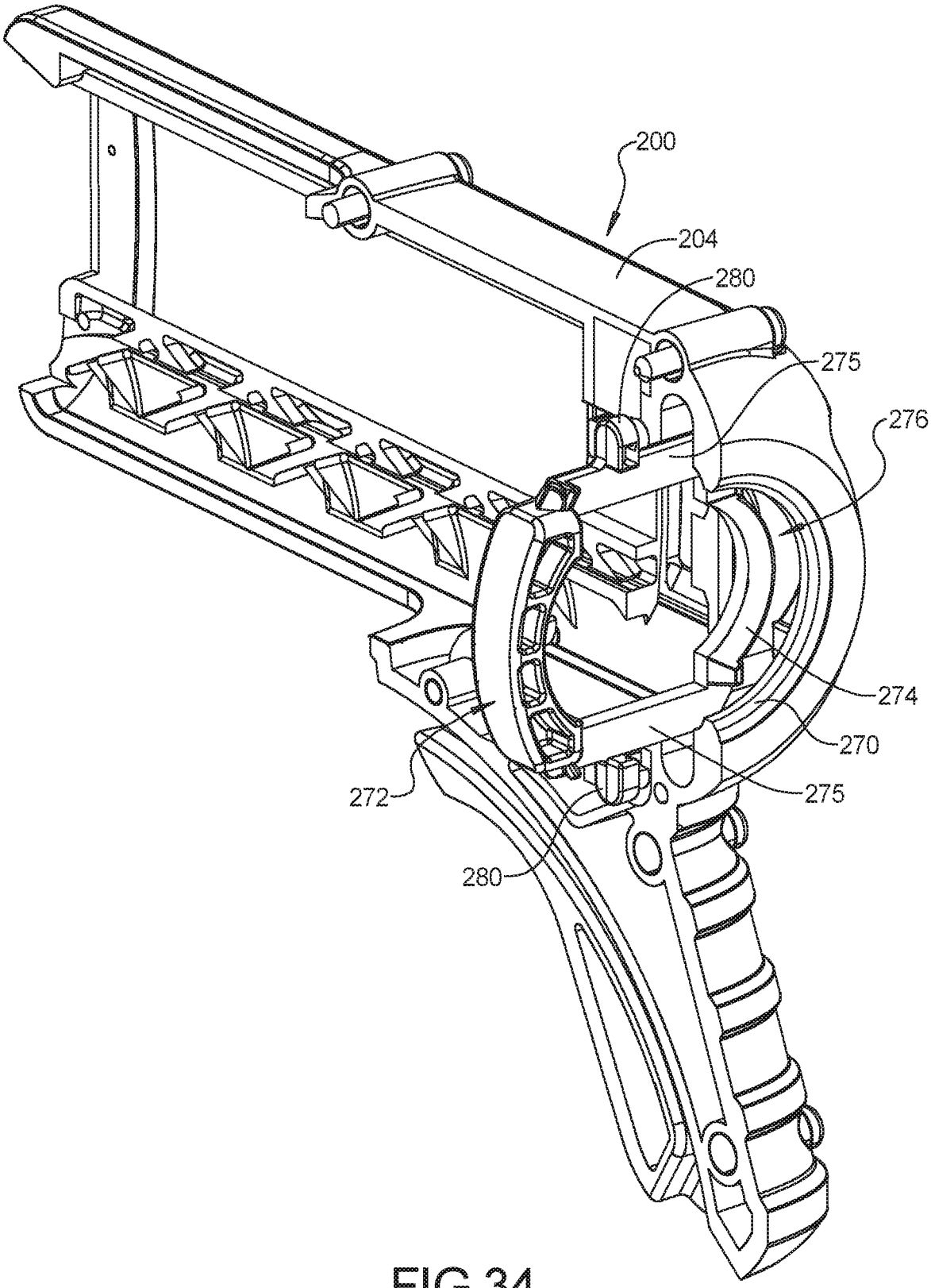

With reference to FIGS. 31-34 the attachment mechanism 220 will now be described. The attachment mechanism 220 is an alternative embodiment of the previously described attachment mechanism in FIGS. 8-9B. The attachment mechanism 220 enables the collated attachment housing 204 to have a tool-free attachment and release from a gear case 262 of the drywall screw gun 12. As shown in FIG. 31, the gear case 262 of the screw gun 12' has annular grooves 264 provided behind an annular flange 266. The gear case 262 also has flats 268 on opposite sides thereof. As shown in FIG. 34, the collated attachment housing 204 includes a rearward opening 270 that receives the gear case 262 therein. A pair of left and right pushbuttons 272 (only one is shown) are provided on opposite sides of the collated attachment housing 204 and each include an ear portion 274 that is designed to be engaged within the annular grooves 264 of the gear case 262. The ear portions 274 are connected to the push buttons 272 by upper and lower bridge sections 275.

As shown in FIG. 34, the rear surface of the ear portions 274 can be provided with a ramped surface 276 which are designed to engage a corresponding ramped surface 278 on the forward side of the annular flange 266 of the gear case 262 to cause the pushbuttons 272 to be drawn inward toward one another to allow the collated attachment housing 204 to be attached to the gear case 262 without depressing the release buttons 272. The bridge sections 275 of the release buttons 272 are each provided with spring seat portions 280 which oppose one another and receive a biasing spring 282 (FIG. 33) thereon for biasing the release buttons 272 in opposite directions so as to secure the ear portions 274 behind the annular flange 266 of the gear case 262. When the release buttons 272 are pressed toward each other (as shown in FIG. 33) against the force of the springs 282, the ear portions 274 move radially outward from the gear case groove 264, enabling the housing 204 to be removed from or attached to the gear case 262. When the buttons are released, the ear portions 274 move radially inward due to the force of the springs 282, causing the ear portions 274 to engage the groove 264 in the gear case 262 so that the housing 204 is fixed to the gear case 264. The ramped surfaces 276, 278 on the rear of the ear portions 274 and on the front of the gear case annular flange 264 allow a user to push the collated housing 204 onto the gear case 262 and have it lock without the need to depress the release buttons 272.

Figure 35:
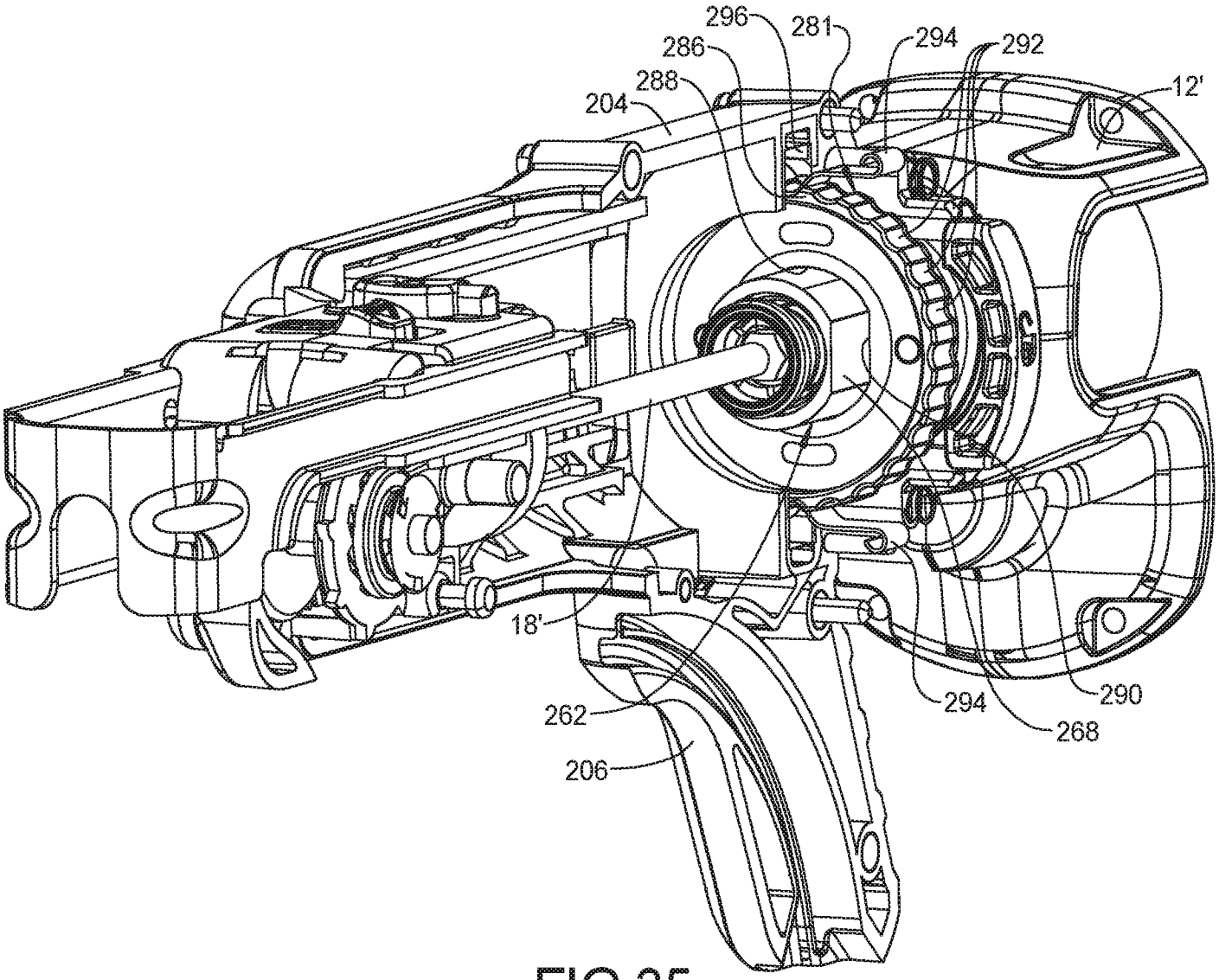
FIG. 35 is a perspective view, partially in section, of an indexing mechanism of the magazine of FIG. 24.

With reference to FIG. 35, the collated attachment housing 204 is provided with an indexing mechanism 281 that allows the collated attachment housing to rotate relative to the screw gun 12 without the need to remove the collated attachment from the gear case 262. The indexing mechanism 281 is an alternate embodiment of the indexing mechanisms shown in FIGS. 9B-16. The indexing mechanism 281 includes a round indexing ring 286 that is held axially in place in the collated attachment housing 204 and includes a central aperture 288 therethrough that is provided with flats 290 that correspond with the flats 268 provided on opposite sides of the gear case 262. Due to the engagement of the flats 290 of the index plate 286 with the flats 268 of the gear case 262, the index plate 286 is rotationally fixed to the gear case 262. The index plate 286 includes a plurality of recesses 292 on its periphery. The collated attachment housing 204 supports a pair of leaf springs 294 each having a detent or protrusion that engages the recesses 292 on the periphery of the index plate 286. The springs 294 allow the collated attachment housing 204 to be positively locked at a plurality of rotational positions as the housing 204 can be rotated relative to the fixed index plate 286. The index plate 286 is disposed within a recessed channel 296 in the collated attachment housing 204. In an alternative embodiment, an indexing plate and/or a plurality of recesses may be non-rotationally fixed to the housing, while a spring and/or protrusion may be non-rotationally fixed to the gear case of the tool so that the magazine can be rotated relative to the tool in a plurality of discrete positions relative to the tool housing.

Figure 36:
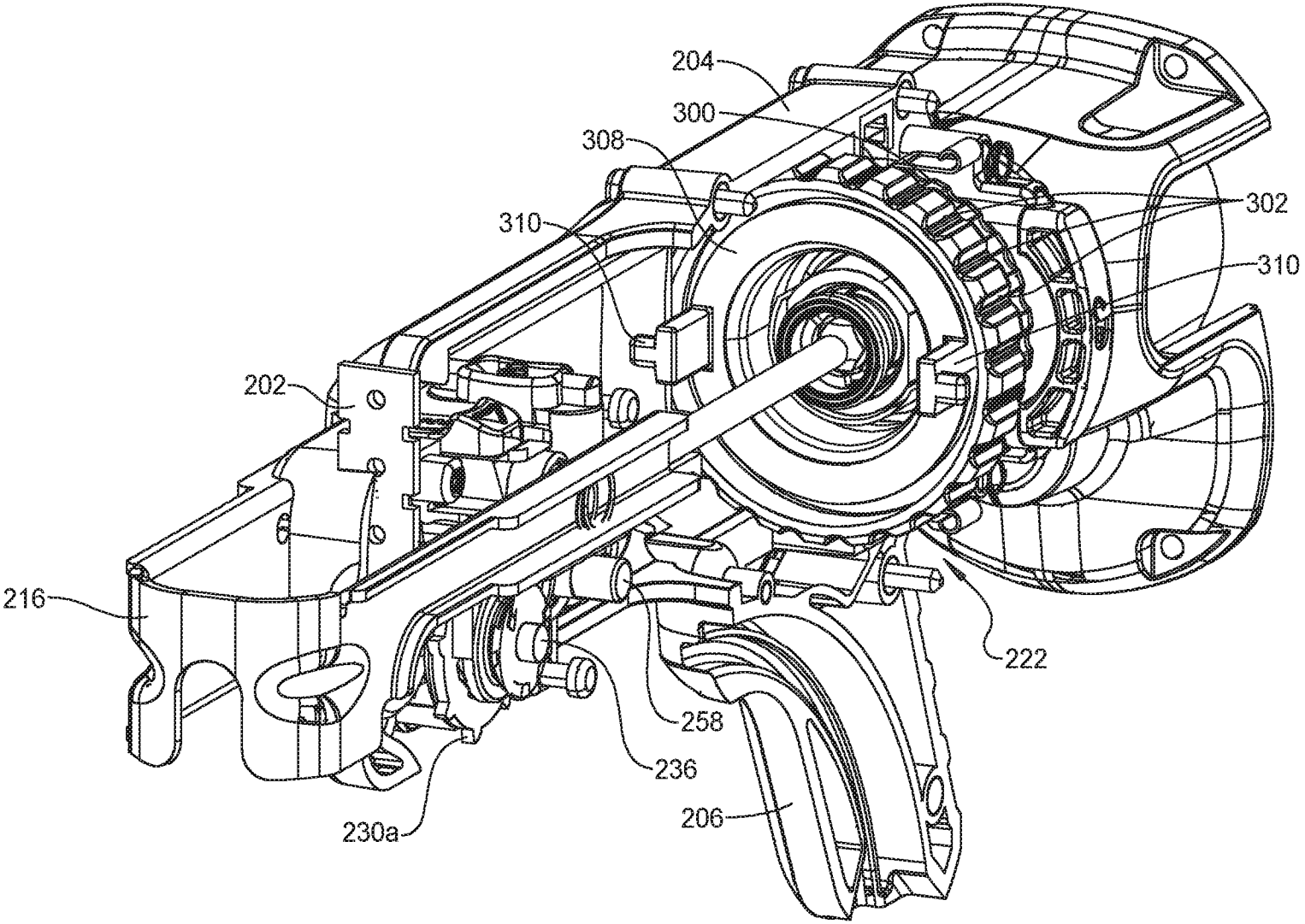
FIGS. 36 and 37 are perspective views, partially in section, of a fine depth adjusting mechanism of the magazine of FIG. 24.
Figure 37:
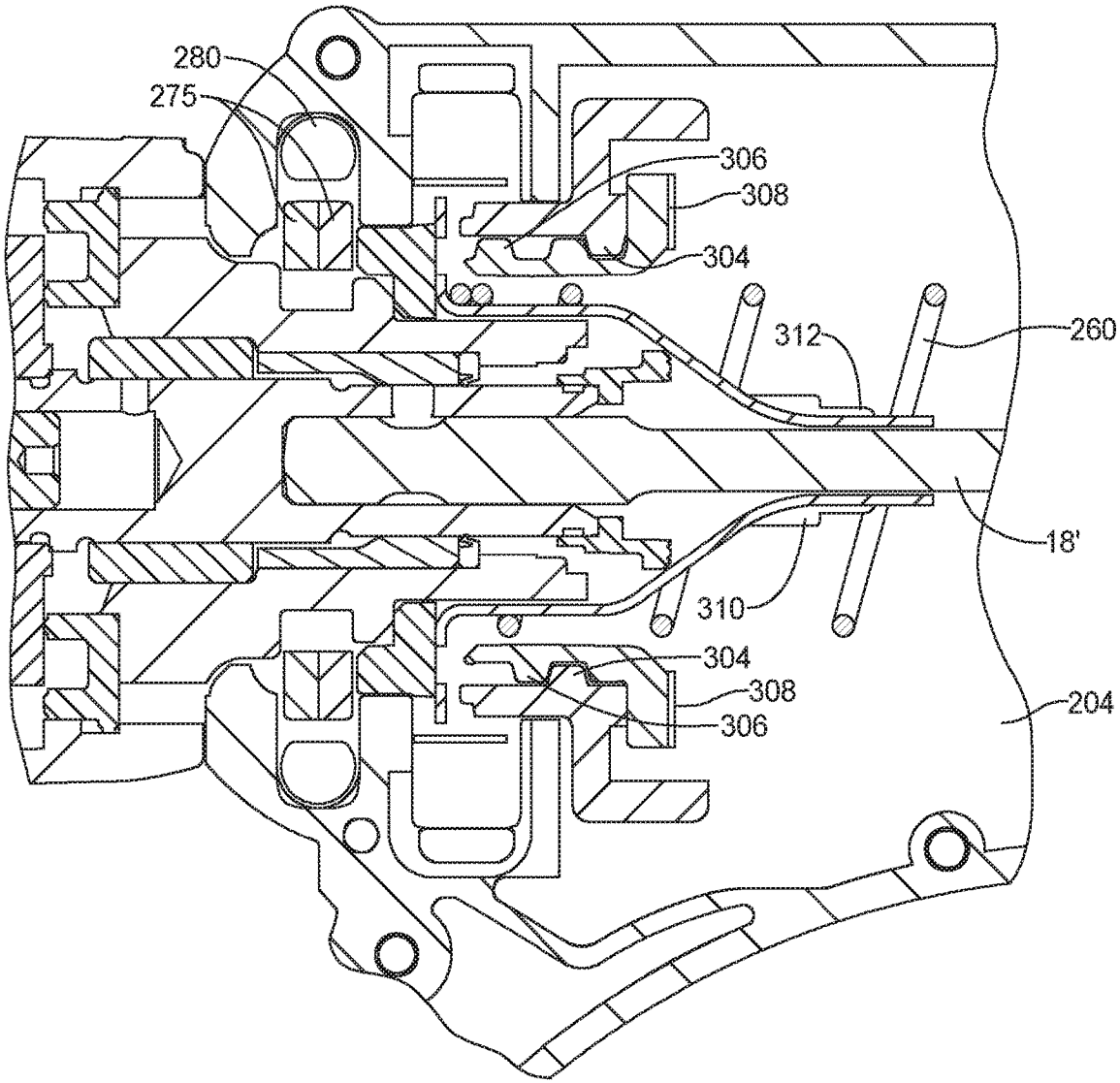

With reference to FIGS. 36-37, the fine depth adjustment mechanism 222 will now be described. The fine depth adjustment mechanism 222 allows the user to adjust the depth to which the shoe 208 can be retracted inside of the collated attachment housing 204 when the nose piece 216 is depressed against a workpiece. The fine depth adjustment mechanism 222 includes a thumb wheel 300 that is rotatably mounted to the collated attachment housing 204 with a portion of the thumbwheel 300 exposed through an opening in the side of the housing 204 (best shown in FIG. 24). The thumbwheel 300 can include a plurality of serrations 302 on an outer surface thereof and can include internal threads 304 that engage external threats 306 of a stop plate 308, as illustrated in FIG. 37. The stop plate 308 has a pair of sidearms 310 received in windows 312 in the housing 204, which enable the stop plate 308 to move axially by an amount that is limited by the length of the windows 312, but is keyed to the collated attachment housing 204 for preventing it from rotating. Therefore, rotation of the thumbwheel 300 relative to the housing 204 causes the stop plate 308 to move axially relative to the housing 204 due to the threaded connection with the thumbwheel 300.

When the nose piece 216 is depressed against a workpiece, the shoe 208 will retract into the housing 204 until the shoe 208 abuts the stop plate 308. A spring detent is provided (not shown) which engages with the serrations 302 on the periphery of the thumbwheel 300 preventing the thumbwheel 300 from accidentally rotating out of a desired position. The threaded engagement between the thumbwheel 300 and the stop plate 308 provides for a fine depth adjustment of the movement of the shoe 208 within the housing 204.

Figure 38:
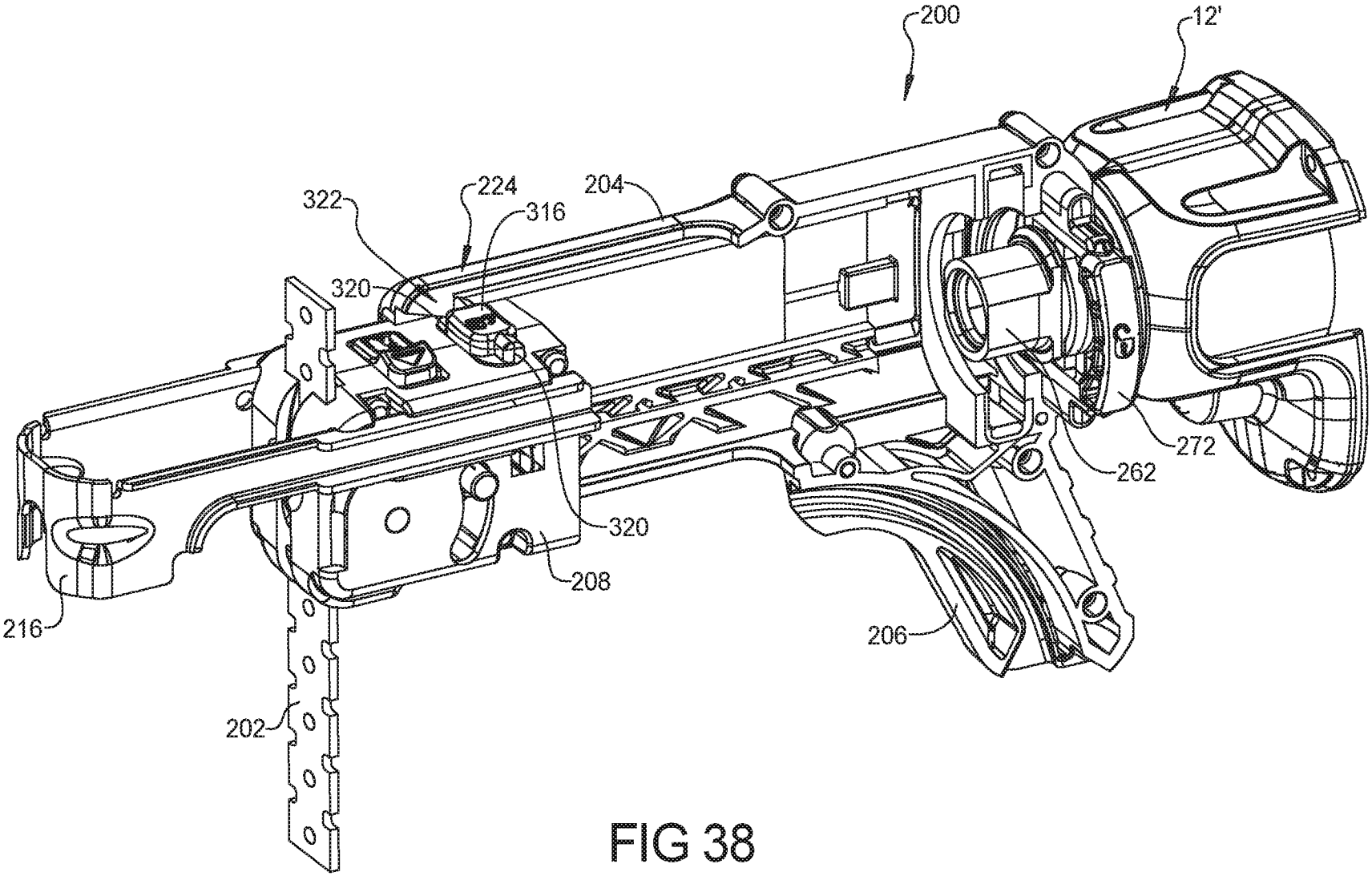
FIG. 38 is a perspective view, partially in section, of a release mechanism for the show of the magazine of FIG. 24.
Figure 39:
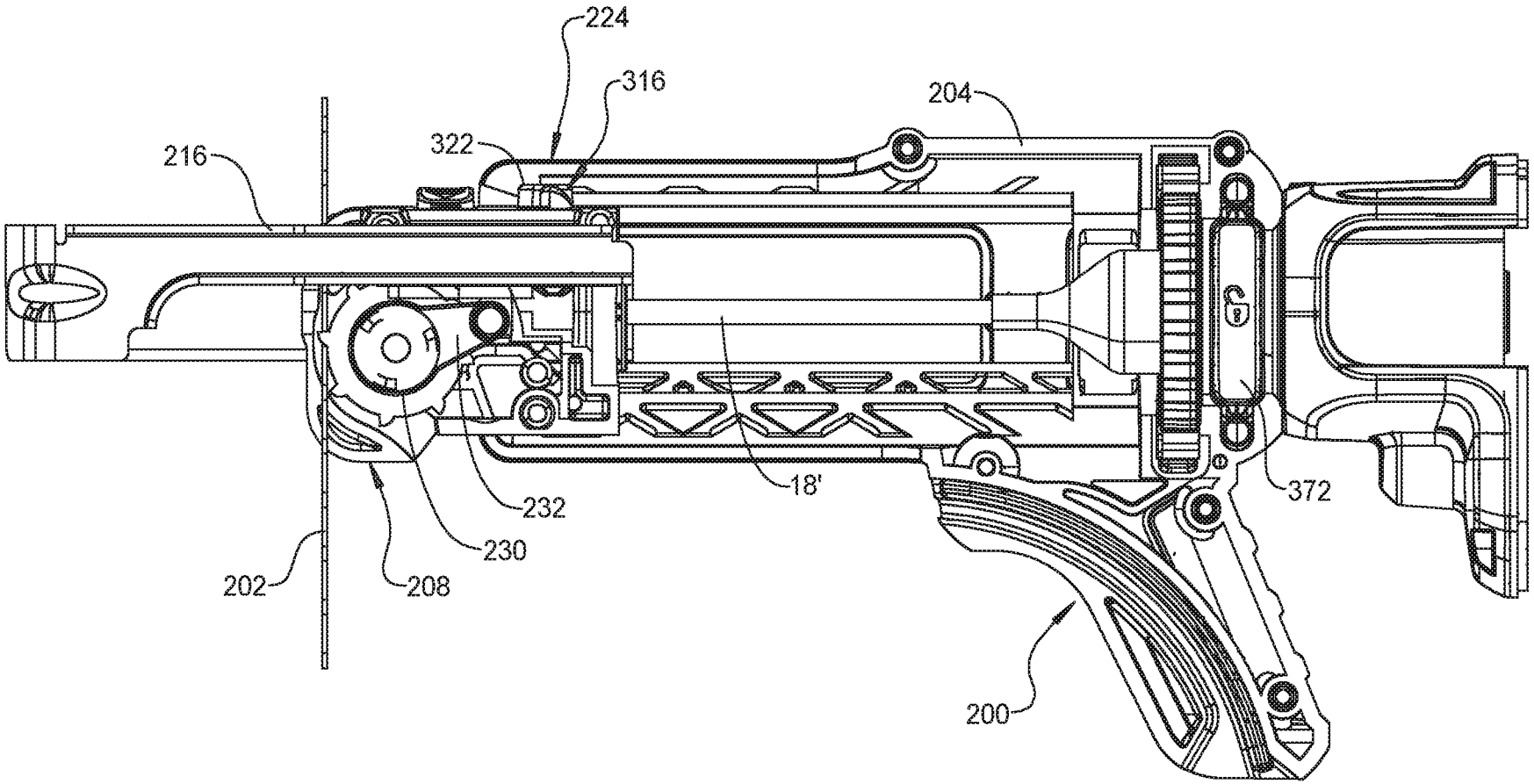
FIG. 39 is a side view, partially in section, of the release mechanism of FIG. 38.

With reference to FIGS. 38 and 39, the push button shoe release mechanism 224 will now be described. The push button shoe release mechanism 224 allows the shoe 208 to be easily releasable from the collated attachment housing 204 in order to facilitate maintenance of the collated attachment mechanism 200. The shoe 208 includes a push button 316 on the top of the shoe 208 that is spring biased, by a spring 318 (best shown in FIG. 25), away from the shoe 208. The push button 316 is connected to a pair of sidearms 320 that are received against a stop shoulder 322 that provide a stop on the inside wall of the housing 204. The receipt of the sidearms 320 against the stop shoulder 322 of the housing 204 limit forward movement of the shoe 208. When the push button 316 is depressed, the sidearms 320 can clear the stop shoulder 322 inside of the housing 204, enabling the shoe 208 to be removed from the housing 204. The push button shoe release mechanism 224 enables the release of the shoe 208 from the housing 204 without the use of a separate tool.

Figure 40:
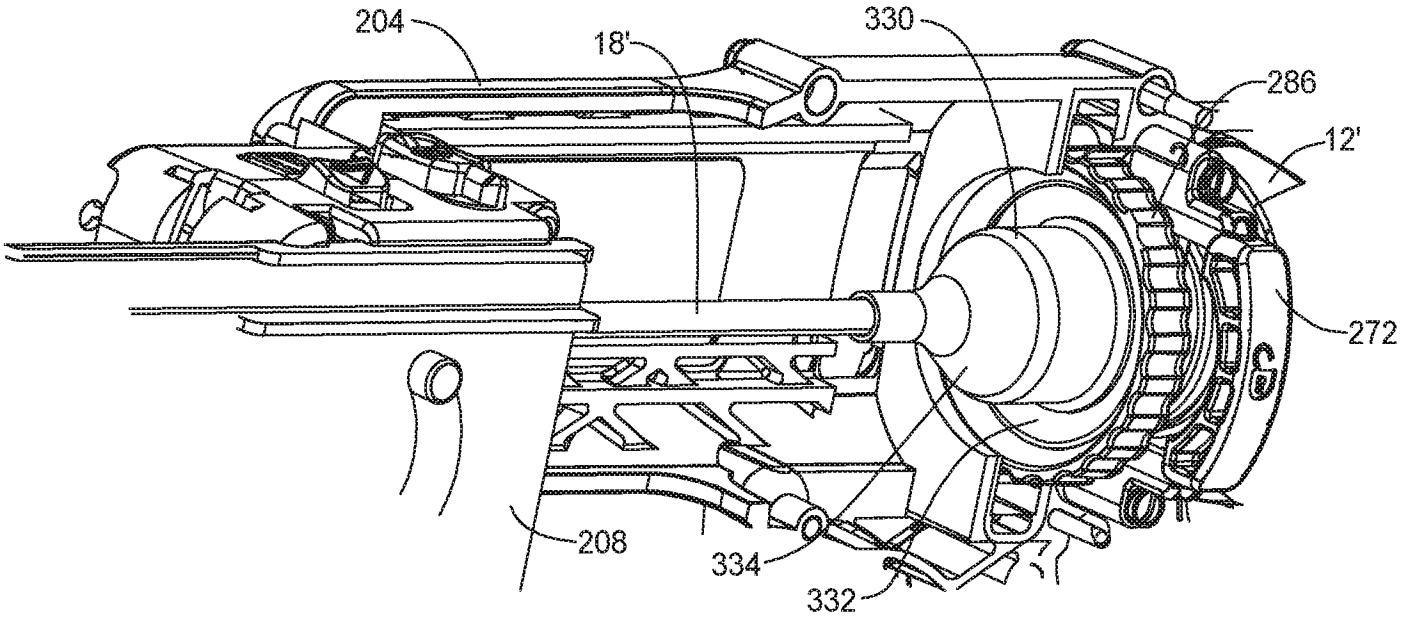
FIG. 40 is a perspective view, partially in section, of a conical bit guide of the magazine of FIG. 24.

With reference to FIG. 40, a conical bit guide 330 is fixed to the indexing plate 286. The bit guide 330 includes an annular flange portion 332 that can be fixed to the indexing plate 286. A conical section 334 extends from the annular flange 332 and facilitates the installation of the collated attachment mechanism 200 to the screw gun 12' by limiting potential misalignment of the screwdriver bit 18' by allowing the screwdriver bit 18 to be properly seated through the conical surface of the bit guide 330. Therefore the conical bit guide 330 serves as an alignment mechanism while the collated attachment 200 is being attached to the screw gun 12'.

Figure 41:
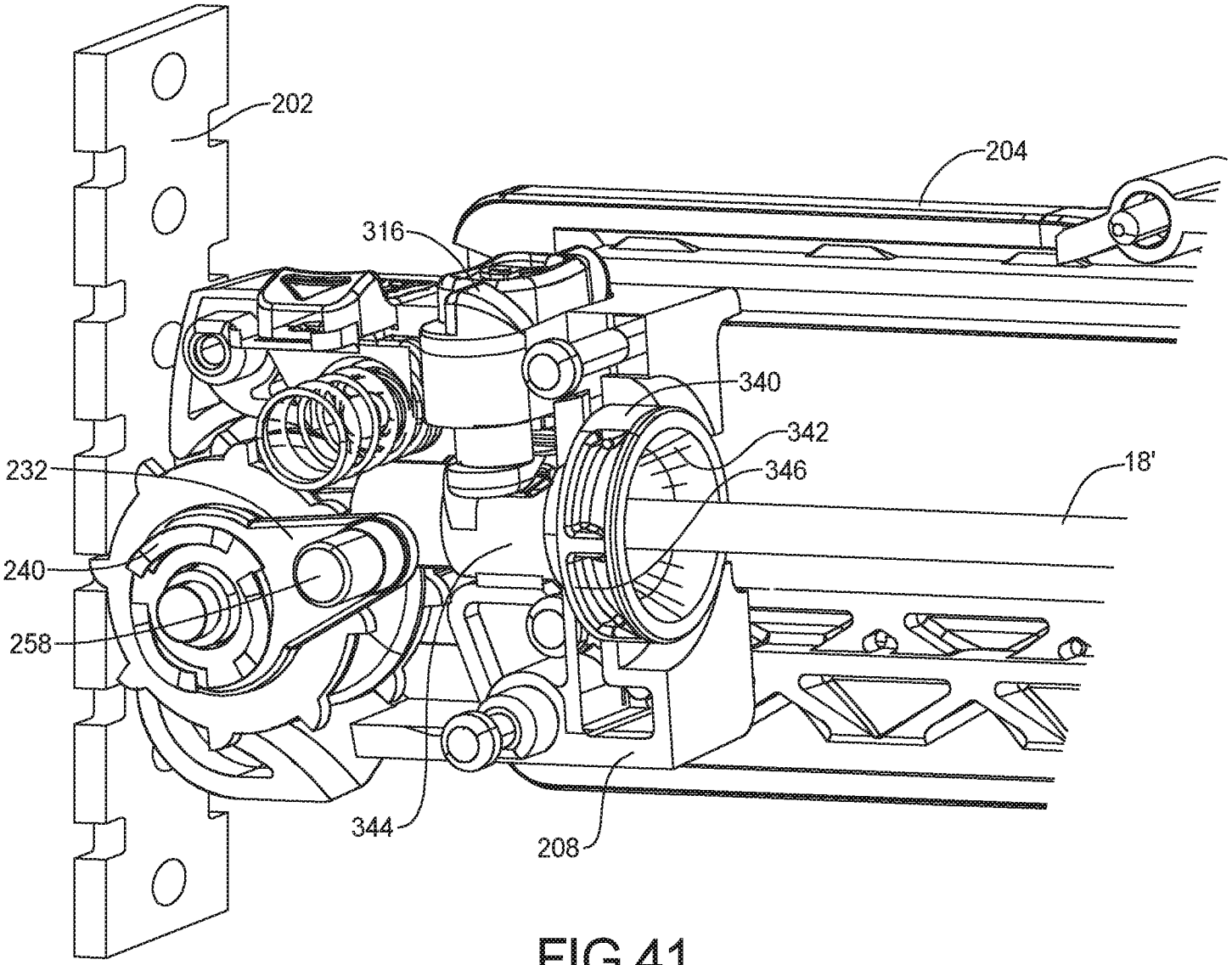
FIG. 41 is a perspective view, partially in section, of a front bearing assembly of the magazine of FIG. 24

With reference to FIG. 41, a front bearing assembly 340 according to the principles of the present disclosure will now be described. The front bearing assembly 340 includes a bit guide portion comprising conical inner wall 342 for guiding a screwdriver bit 18 therethrough. A bearing structure 344 is provided forward of the conical surface 342. The bearing assembly 340 is internal to the shoe 208. An exterior surface 346 of the bearing assembly 340 is received within the return spring 260 (best shown in FIG. 25) that biases the shoe 208 to its forward position. The generally cylindrical exterior surface 346 of the bearing assembly 340 helps to stabilize and guide the return spring 260.

Figure 42:
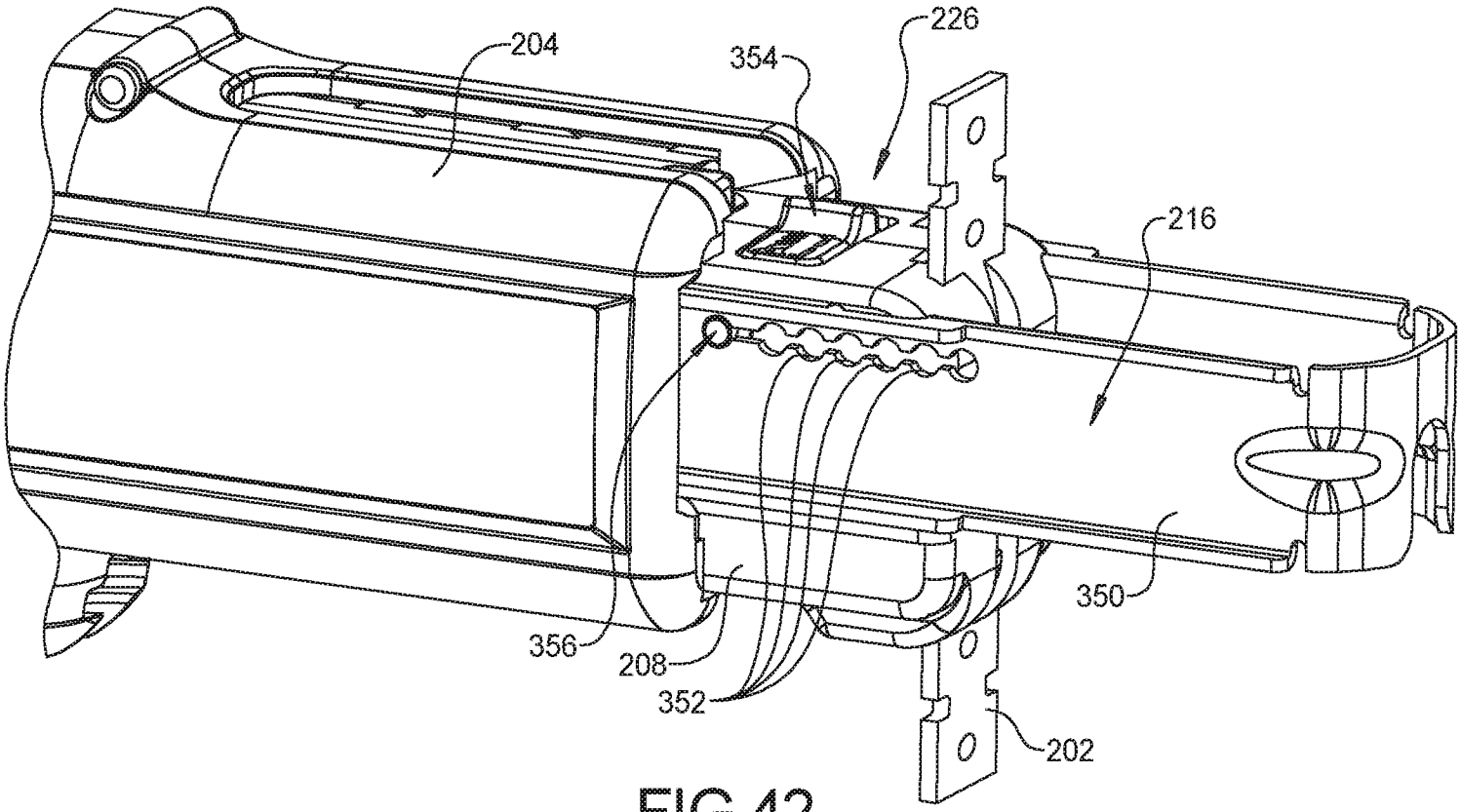
FIG. 42 is a perspective view of a nosepiece depth adjustment assembly of the magazine of FIG. 24.
Figure 43:
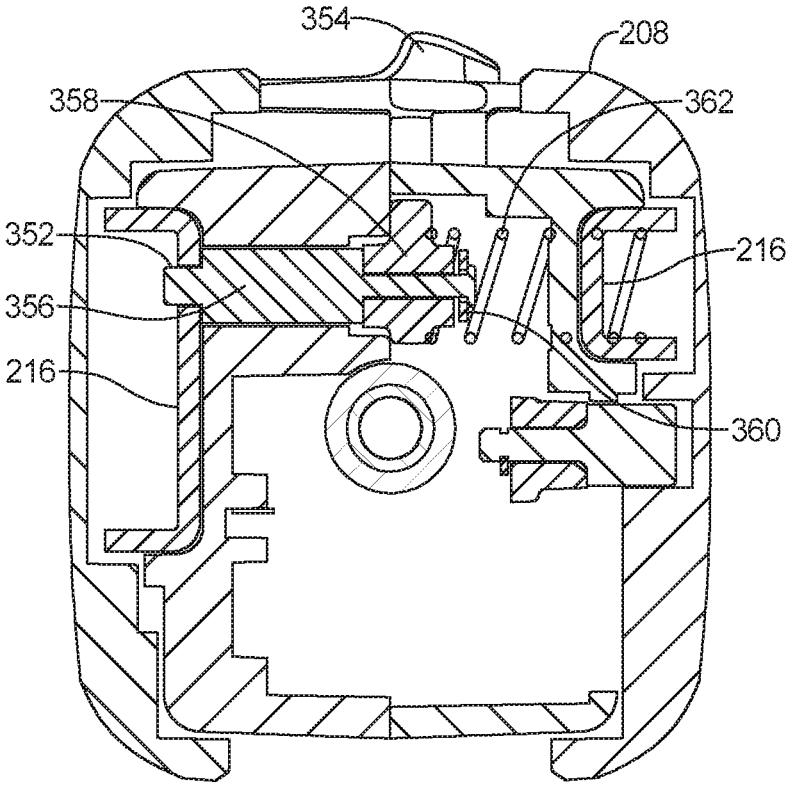
FIG. 43 is a perspective view, partially in cross-section, of the nosepiece depth adjustment assembly of FIG. 42.

With reference to FIGS. 42 and 43, the nosepiece depth adjustment mechanism 226 will now be described. The nosepiece depth adjustment mechanism 226 allows the position of the nose piece 216 to be adjusted relative to the shoe 208 to accommodate for screws S having different lengths. As shown in FIG. 42, a side arm 350 of the nosepiece 216 includes a plurality of round openings 352. The shoe 208 includes a laterally movable nose piece adjustment tab 354 that is connected to a locking pin 356. The end of the locking pin 356 is engageable with one of the plurality of round openings 352 in the side arm 350 of the nosepiece 216. With reference to FIG. 20, the locking pin 356 is connected to the adjustment tab 354 by a sleeve 358 that is secured on the locking pin 356 by a retaining ring 360. A biasing spring 362 is disposed between an interior wall of the shoe 208 and the sleeve 358 to bias the locking pin 356 toward the engaged position within one of the round openings 352. When the adjustment tab 354 is pressed toward a release position, the compression spring 362 is compressed and the locking pin 356 is removed from one of the round openings 352 so that the position of the nosepiece 216 can be adjusted relative to the shoe 208. When the adjustment tab 354 is released, the locking pin is biased back into one of the nosepiece openings 352 so that the locking pin 356 engages one of the openings to maintain the nosepiece 216 at a desired depth. Adjustment of the nosepiece 216 relative to the collated strip 202 of fasteners allows for screws having different lengths.

Figure 44:
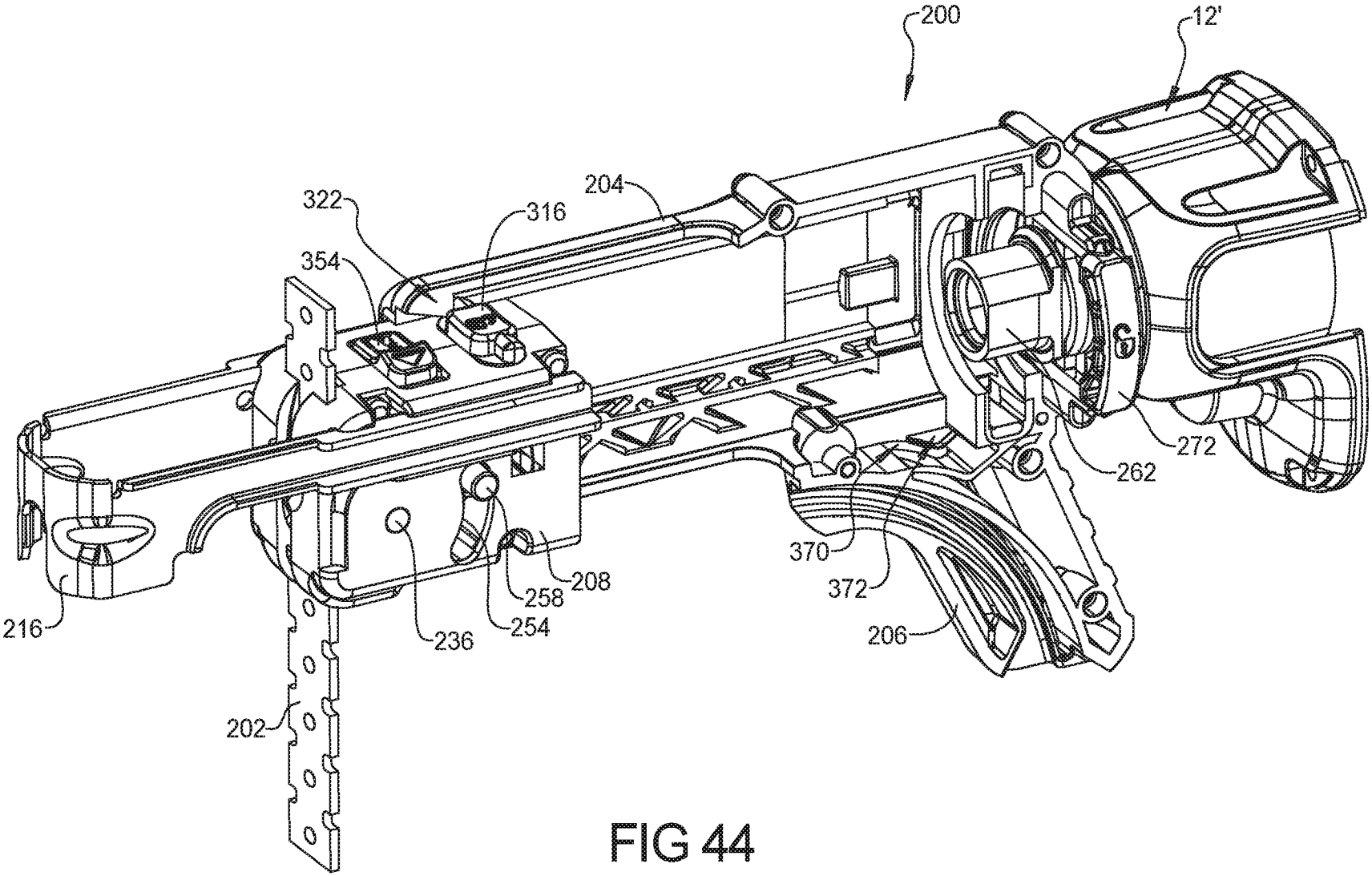
FIG. 44 is a perspective view of the magazine of FIG. 42 with a portion of the housing removed.

With reference to FIG. 44, the handle 206 of the collated attachment housing 204 is shown including internal grooves 370 and side egress slots 372 that allow the release of dust that collects inside of the housing 204 during use of the collated attachment 200. The egress slots 372 can be provided at strategic locations where dust and debris normally would accumulate within the housing to allow the dust and debris to be expelled there through.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A magazine configured to be coupled to a power tool having a tool housing and a tool holder for holding a screwdriving bit, the magazine comprising:

a magazine housing having a front end portion and a rear end portion configured to be attachable to the power tool housing;

an advancing mechanism coupled to the front end portion and configured to advance a strip of collated fasteners into position to be driven by the screwdriving bit; and a rear bit guide positioned adjacent the rear end portion of the magazine housing and a front bit guide positioned adjacent the front end portion of the magazine housing, wherein each of the rear bit guide and the front bit guide is received in the magazine housing between the front end portion and the rear end portion rearward of the advancing mechanism, and each of the rear bit guide and the front bit guide includes a hollow inner surface tapering inward toward the front end portion of the magazine housing to receive the screwdriving bit for proper alignment of the screwdriving bit relative to the collated fasteners.

2. The magazine of claim 1, wherein the rear bit guide is coupled to an indexing mechanism configured to enable rotation of the magazine housing relative to the tool housing while the magazine housing is coupled to tool housing.

3. The magazine of claim 2, wherein the rear bit guide has a cylindrical outer surface coupled to the indexing mechanism.

4. The magazine of claim 1, wherein the front bit guide is positioned adjacent the front end portion of the magazine housing.

5. The magazine of claim 4, wherein the front bit guide is coupled to a bearing structure that is at least partially received in a shoe moveably coupled to the front end portion.

6. The magazine of claim 5, wherein the front bit guide includes a cylindrical exterior surface coupled to a return spring that biases the shoe away from the front end portion.

7. A magazine and power tool assembly comprising:

a power tool including a tool housing that contains a motor and a tool holder coupled to the power tool housing and configured to hold a screwdriving bit, the tool holder being driven in rotation relative to the power tool housing by the motor; and a magazine including a magazine housing with a front end portion and a rear end portion configured to be attachable to the power tool housing, an advancing mechanism coupled to the front end portion and configured to advance a strip of collated fasteners into position to be driven by the screwdriving bit, and a rear bit guide and a front bit guide received in the magazine housing rearward of the advancing mechanism, the each of the bit guides including a hollow inner surface tapering inward toward the front end portion of the magazine housing to receive the screwdriving bit for proper alignment of the screwdriving bit relative to the collated fasteners, and the at least one bit guide attachable non-rotatably to the power tool housing.

8. The magazine of claim 7, wherein the at least one bit guide comprises a rear bit guide positioned adjacent the rear end portion of the magazine housing.

9. The magazine of claim 8, wherein the rear bit guide is coupled to an indexing mechanism configured to enable rotation of the magazine housing relative to the tool housing while the magazine housing is coupled to tool housing.

10. The magazine of claim 9, wherein the rear bit guide has a cylindrical outer surface coupled to the indexing mechanism.

11. The magazine of claim 7, wherein the at least one bit guide comprises a front bit guide positioned adjacent the front end portion of the magazine housing.

12. The magazine of claim 11, wherein the front bit guide is coupled to a bearing structure that is at least partially received in a shoe moveably coupled to the front end portion.

13. The magazine of claim 12, wherein the front bit guide includes a cylindrical exterior surface coupled to a return spring that biases the shoe away from the front end portion.

14. The magazine of claim 7, wherein the at least one bit guide comprises a rear bit guide positioned adjacent the rear end portion of the magazine housing and a front bit guide positioned adjacent the front end portion of the magazine housing.

15. A magazine configured to be coupled to a power tool housing having a tool holder for holding a screwdriving bit, the magazine comprising:

magazine housing having a front end portion and a rear end portion configured to be attachable to the power tool housing;

an advancing mechanism coupled to the front end portion and configured to advance a strip of collated fasteners into position to be driven by the screwdriving bit;

a shoe coupled to the front end portion of the magazine housing and configured to reciprocate relative to the magazine housing to cause the advancing mechanism to advance the strip of collated fasteners; and a bit guide received in the magazine housing adjacent the front end portion the bit guide including a hollow inner conical surface disposed rearward of the advancing mechanism, the conical surface extending tapering inward toward the front end portion of the magazine housing, the bit guide configured to receive the screwdriving bit for proper alignment of the screwdriving bit relative to the collated fasteners.

16. The magazine of claim 15, wherein the bit guide is coupled to a bearing structure that is at least partially received in the shoe.

17. The magazine of claim 16, wherein the bit guide includes a cylindrical exterior surface coupled to a return spring that biases the shoe away from the front end portion.

18. The magazine of claim 15, further comprising a second bit guide received in the magazine housing adjacent the rear end portion, the second bit guide including a second inner conical surface tapering inward toward the front end portion of the magazine housing to receive the screwdriving bit for proper alignment of the screwdriving bit relative to the collated fasteners.

19. The magazine of claim 1, wherein each of the rear bit guide and the front bit guide includes a hollow inner conical surface tapering inward toward the front end portion of the magazine housing to receive the screwdriving bit for proper alignment of the screwdriving bit relative to the collated fasteners.

* * * * *